US009474938B1

(12) United States Patent
McNaughton

(10) Patent No.: US 9,474,938 B1
(45) Date of Patent: Oct. 25, 2016

(54) CLIMBING DEVICE

(71) Applicant: David James McNaughton, Chardon, OH (US)

(72) Inventor: David James McNaughton, Chardon, OH (US)

( * ) Notice: Subject to any disclaimer, the term of this patent is extended or adjusted under 35 U.S.C. 154(b) by 0 days.

(21) Appl. No.: 14/868,157

(22) Filed: Sep. 28, 2015

Related U.S. Application Data

(63) Continuation-in-part of application No. 13/588,328, filed on Aug. 17, 2012, now Pat. No. 9,144,710.

(60) Provisional application No. 61/674,065, filed on Jul. 20, 2012, provisional application No. 61/674,314, filed on Jul. 21, 2012.

(51) Int. Cl.
*A63B 27/00* (2006.01)

(52) U.S. Cl.
CPC ..... *A63B 27/00* (2013.01)

(58) Field of Classification Search
CPC ..... A01M 31/02; A63B 27/00
See application file for complete search history.

(56) References Cited

U.S. PATENT DOCUMENTS 2,499,753 A * 3/1950 Hubbard ..... F16G 11/12 24/116 R
4,109,761 A * 8/1978 Matlock ..... A63B 27/00 182/92
4,422,527 A * 12/1983 Schultz ..... A63B 27/00 182/187
4,600,081 A * 7/1986 Wade ..... A01M 31/02 108/152
4,659,044 A * 4/1987 Armstrong ..... F16M 13/02 114/343
4,674,597 A * 6/1987 Humphrey ..... A63B 27/00 182/189
5,156,096 A * 10/1992 Lamprey ..... A47B 96/027 108/108
5,279,388 A * 1/1994 Laughlin ..... A63B 27/00 182/90
5,810,113 A * 9/1998 Jones ..... A63B 27/00 182/90
6,431,315 B1 * 8/2002 Lewis ..... A63B 27/00 182/136
7,690,481 B1 * 4/2010 Pederson ..... A01M 31/02 182/133
7,753,170 B1 * 7/2010 Gibson ..... E06C 7/14 182/107
8,418,808 B2 * 4/2013 Merritt ..... A63B 27/00 182/92

* cited by examiner

*Primary Examiner* — Alvin Chin-Shue
*Assistant Examiner* — Candace L Bradford
(74) *Attorney, Agent, or Firm* — Renner, Kenner, Greive, Bobak Taylor & Weber

(57) ABSTRACT

A device for a removable attachment to a column member, such as a tree, includes a body having a pair of spaced contact surfaces. The body also includes a pair of spaced and elongated retention apertures that are configured to receive a flexible retention member, such as a strap, therethrough. The retention member initially retains the device to the column member, such that the contact surfaces are urged against the column member. In addition, the retention members are spaced apart such that their top portions are spaced further apart than their bottom portions. Thus, as the body is forced downward along the column member, the distance between the spaced retention apertures increases, causing the circumferential distance traversed by the retention member to increase, thus drawing the retention member taut.

2 Claims, 27 Drawing Sheets

CLIMBING DEVICE

CROSS-REFERENCE TO RELATED APPLICATIONS

This application is a continuation-in-part of U.S. patent application Ser. No. 13/588,328 filed on Aug. 17, 2012, which claims the benefit of U.S. Provisional Application No. 61/674,065 filed on Jul. 20, 2012, and U.S. Provisional Application No. 61/674,314 filed on Jul. 21, 2012, the content each of which is incorporated herein by reference.

TECHNICAL FIELD

The present invention relates to devices used to climb a column member, such as a tree. Particularly, the present invention relates to a portable climbing device that is configured to be removably attached to a column member. More particularly, the present invention relates to a climbing device that is secured to a column member by a flexible retention member.

BACKGROUND OF THE INVENTION

Various individuals such as hunters, researchers, photographers, and arborists often need to ascend column members, such as trees or poles for example. To achieve this, such individuals are required to carry all of their climbing equipment with them to the climbing site on foot, sometimes for considerable distances. Unfortunately, current climbing devices are heavy and/or awkward to carry, and in many circumstances are cumbersome to use.

In addition, an increasing number of States have passed regulations prohibiting the use of any climbing device that damages trees on public hunting land. However, many climbing devices impart damage to trees when they are used and as such, are prohibited from use on such public land. In addition, homeowners who employ the services of arborists would also benefit from a climbing device that does not damage the trees they need to maintain.

Furthermore, individuals such as hunters, photographers, and naturalists are required to maintain a quiet or stealth presence as they enter the field to prevent startling or otherwise alerting wildlife of their presence. However, many currently available climbing devices generally make noise as they are used and attached to trees or other column member, due to their complex mechanical construction and material used.

Therefore, there is a need for a climbing device that is strong, lightweight, and portable. In addition, there is a need for a climbing device that does not impart damage or trauma to a tree or other column member when attached thereto. Furthermore, there is a need for a climbing device that is quiet and allows a user to maintain a stealth presence when transported and when in use as it is attached to a tree or other column member.

SUMMARY OF THE INVENTION

In light of the foregoing, it is a first aspect of the present invention to provide a climbing device for climbing a column member comprising a body having a top step and a bottom rim; first and second contact surfaces extending at least partially between the first step and second the bottom rim; a concave section disposed between at least the first and second contact surfaces, wherein the width of the concave section decreases as the concave section extends from the top step to the bottom rim; and first and second retention apertures elongated so as to have a top and bottom disposed through the body and spaced apart by the width of the concave section, wherein the first retention aperture is proximate to the first contact surface and the second aperture is proximate to the second contact surface, such that the first and second retention apertures are respectively spaced from the first and second contact surfaces, whereby the first and second retention apertures are configured to receive a flexible retention member therethrough to attach the body to the column member, and wherein the flexible retention member is slideably received from the bottom of the first and second retention apertures to the top of the first and second retention apertures when in use.

It is another aspect of the present invention to provide a method for using a climbing device comprising providing a climbing device comprising a body that includes a top step and a bottom rim; first and second contact surfaces extending at least partially between the first step and the bottom rim; a concave section disposed between at least the first and second contact surfaces, wherein the width of the concave section decreases as the concave section extends from the top step to the bottom rim; and first and second retention apertures elongated so as to have a top and bottom disposed through the body and spaced apart by the width of the concave section, wherein the first retention aperture is proximate to the first contact surface and the second retention aperture is proximate to the second contact surface, such that the first and second retention apertures are respectively spaced from the first and second contact surfaces; attaching the body to a column member by placing a flexible retention member through the first and second retention apertures, the first and second contact surfaces are at least partially in contact with the column member; and forcing the body downward, such that the flexible retention member is slideably received from the bottom of the first and second retention apertures to the top of the first and second retention apertures when in use.

Another aspect of the present invention is a device for attachment to a column member, the device further comprising a body having a top edge and a bottom edge, the body having a longitudinal axis; a first contact surface and a second contact surface, spaced apart, and extending at least partially between the top edge and the bottom edge, wherein the first and second contact surfaces are substantially smooth; a first support section extending from at least one of the top edge or the bottom edge, the first support section proximate to the first contact surface; a second support section extending from at least one of the top edge or the bottom edge, the second support section proximate to the second contact surface; and a first elongated retention aperture disposed through the first support section and spaced from the first contact surface, and a second elongated retention aperture disposed through the second support section and spaced from the second contact surface, the first and second retention apertures each having a top portion proximate to the top edge and a bottom portion extending at least partially towards the bottom edge, wherein the first support section and the second support section diverge away from the longitudinal axis of the body from the bottom edge to the top edge, such that the top portions of the first and second retention apertures are spaced further apart from each other than the bottom portions of the first and second retention apertures are spaced apart from each other; wherein the first and second retention apertures are configured to receive a flexible retention member therethrough to attach the body to the column member, such that the flexible retention member remains fixed in position relative to the column member, whereby the first and second retention apertures are slideable relative to the retention member, such that only the top portions of the first and second retention apertures or the bottom portions of the first and second retention apertures are positionable proximate to the retention member at any one time.

And yet another aspect of the present invention is a method for using a device comprises providing a device comprising a body having a top edge and a bottom edge, the body having a longitudinal axis; a first contact surface and a second contact surface, spaced apart, and extending at least partially between the top edge and the bottom edge, wherein said first and second contact surfaces are substantially smooth; a first support section extending from at least one of said top edge or said bottom edge, said first support section proximate to said first contact surface; a second support section extending from at least one of said top edge or said bottom edge, said second support section proximate to said second contact surface; and a first elongated retention aperture disposed through said first support section and spaced from said first contact surface, and a second elongated retention aperture disposed through said second support section and spaced from said second contact surface, said first and second retention apertures each having a top portion proximate to said top edge and a bottom portion proximate to said bottom edge, wherein said first support section and said second support section diverge away from the longitudinal axis of said body from said bottom edge to said top edge, such that said top portions of said first and second retention apertures are spaced further apart from each other than said bottom portions of said first and second retention apertures are spaced apart from each other; placing a flexible retention member through said first and second retention apertures proximate to said bottom portions to attach said body to the column member, such that the flexible retention member remains fixed in position relative to the column member and at least a portion of said first and second contact surfaces are in contact with the column member; and moving said body downward relative to the column member, so as to move said first and second retention apertures relative to said fixed retention member, such that the top portions of said first and second retention apertures are proximate to said retention member to secure said body against the column member.

Another aspect of the present invention is A device for attachment to a column member, the device further comprising a body having a top edge and a bottom edge, said body having a longitudinal axis; a first contact surface and a second contact surface, spaced apart, and extending at least partially between said top step and said bottom edge, wherein said first and second contact surfaces are substantially smooth; a first support section extending from at least one of said top step or said bottom edge, said first support section proximate to said first contact surface; a second support section extending from at least one of said top step or said bottom edge, said second support section proximate to said second contact surface; and a first elongated retention aperture and a second elongated retention aperture each disposed through said first support section and spaced from said first contact surface; a third elongated retention aperture and a fourth elongated retention aperture each disposed through said second support section and spaced from said second contact surface, each one of said retention apertures having a top portion proximate to said top edge and a bottom portion proximate to said bottom edge, wherein said first support section and said second support section diverge away from the longitudinal axis of said body from said bottom edge to said top edge, such that said top portions of said first and third retention apertures are spaced further apart from each other than said bottom portions of said first and third retention apertures are spaced apart from each other, and wherein said top portions of said second and fourth retention apertures are spaced further apart from each other than said bottom portions of said second and fourth retention apertures are spaced apart from each other; wherein said first and third retention apertures are configured to receive a first flexible retention member therethrough and said second and fourth retention apertures are configured to receive a second flexible retention member therethrough, so as to attach said body to the column member, such that the first and second flexible retention members remain fixed in position relative to the column member, whereby said first and third retention apertures are slideable relative to the fixed first retention member, and second and fourth retention members are slideable relative to the fixed second retention member, such that only said top portions of each said retention retention aperture or said bottom portions of each said retention aperture are positionable, so as to be proximate to the retention member at any one time.

Another aspect of the present inventions is A device for attachment to a column member, the device further comprising a body having a top edge and a bottom edge, said body having a longitudinal axis; a first contact surface and a second contact surface, spaced apart, and extending at least partially between said top edge and said bottom edge, wherein said first and second contact surfaces are substantially smooth; a first support section extending from at least one of said top edge or said bottom edge, said first support section proximate to said first contact surface; a second support section extending from at least one of said top edge or said bottom edge, said second support section proximate to said second contact surface; and a first elongated retention aperture disposed through said first support section and spaced from said first contact surface, and a second elongated retention aperture disposed through said second support section and spaced from said second contact surface, said first and second retention apertures each having a top portion proximate to said top edge and a bottom portion extending at least partially towards said bottom edge to an opening, wherein said first support section and said second support section diverge away from the longitudinal axis of said body from said bottom edge to said top edge, such that said top portions of said first and second retention apertures are spaced further apart from each other than said bottom portions of said first and second retention apertures are spaced apart from each other; wherein said first and second retention apertures are configured to receive a flexible retention member therethrough to attach said body to the column member, such that said flexible retention member remains fixed in position relative to the column member, whereby said first and second retention apertures are slideable relative to the retention member, such that only said top portions of said first and second retention apertures or said bottom portions of said first and second retention apertures are positionable proximate to the retention member at any one time.

BRIEF DESCRIPTION OF THE DRAWINGS

The detailed embodiments of the present invention will be better understood by referencing the following descriptions and their accompanying drawings, wherein.

DETAILED DESCRIPTION OF THE INVENTION

Figure 1:
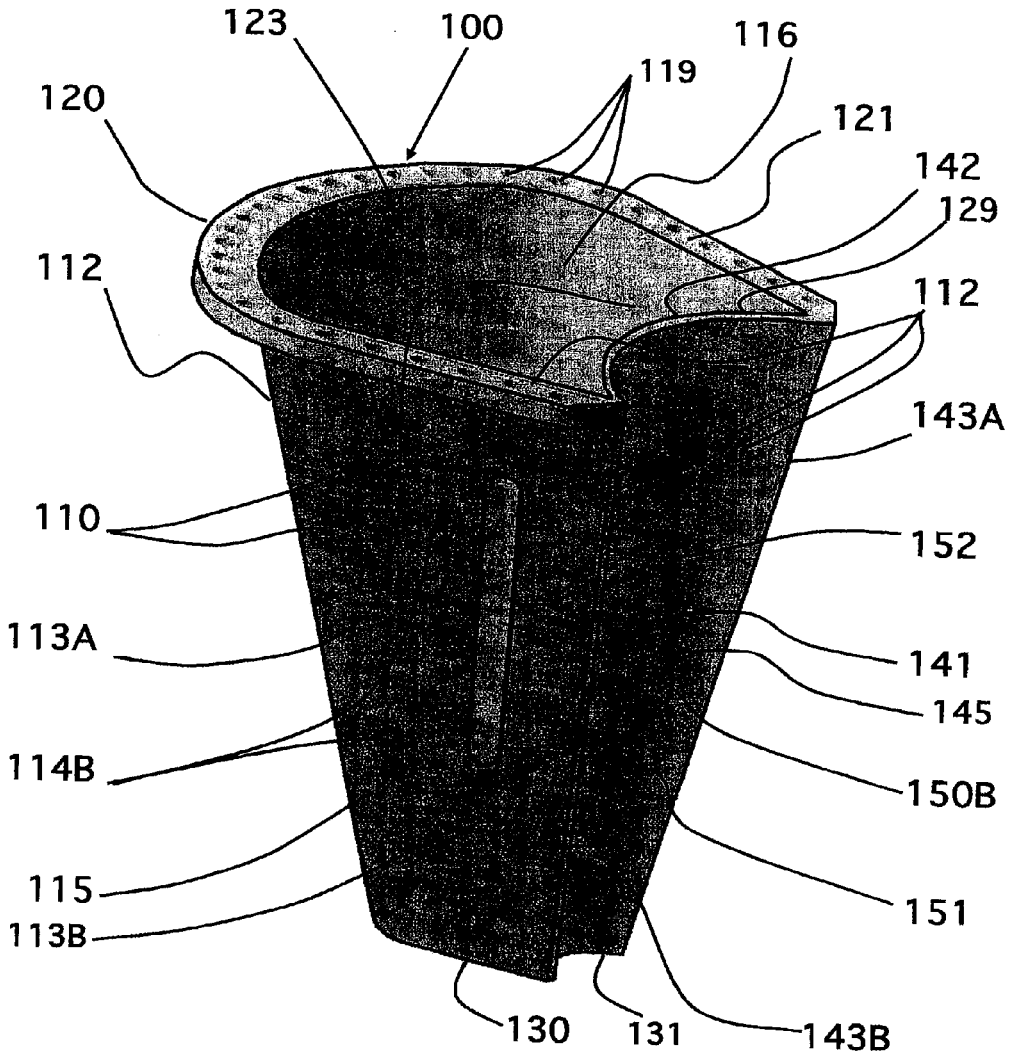
FIG. 1 is an isometric view of the climbing device constructed in accordance with one exemplary embodiment of the present invention, shown top end up and from the rear corner perspective in accordance with the concepts of the present invention.
Figure 2:
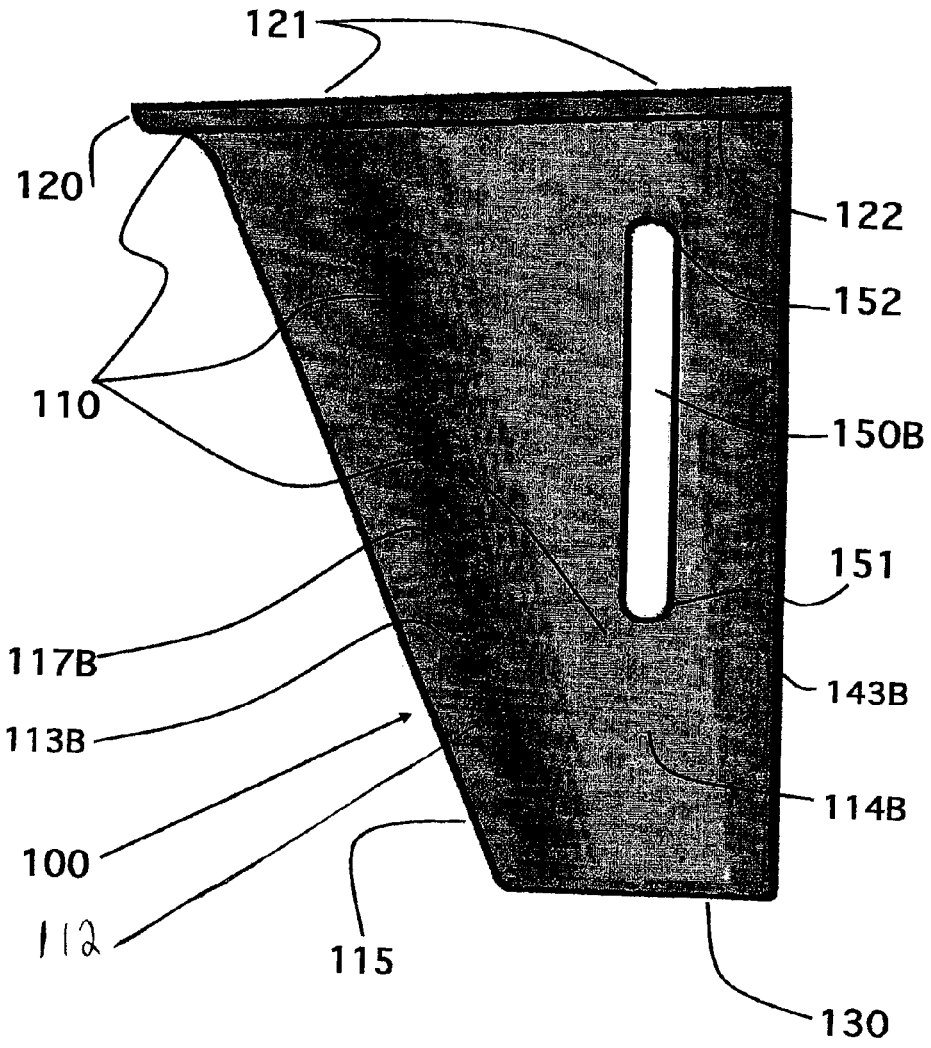
FIG. 2 is a side view of the climbing device of FIG. 1 in accordance with the concepts of the present invention.
Figure 3:
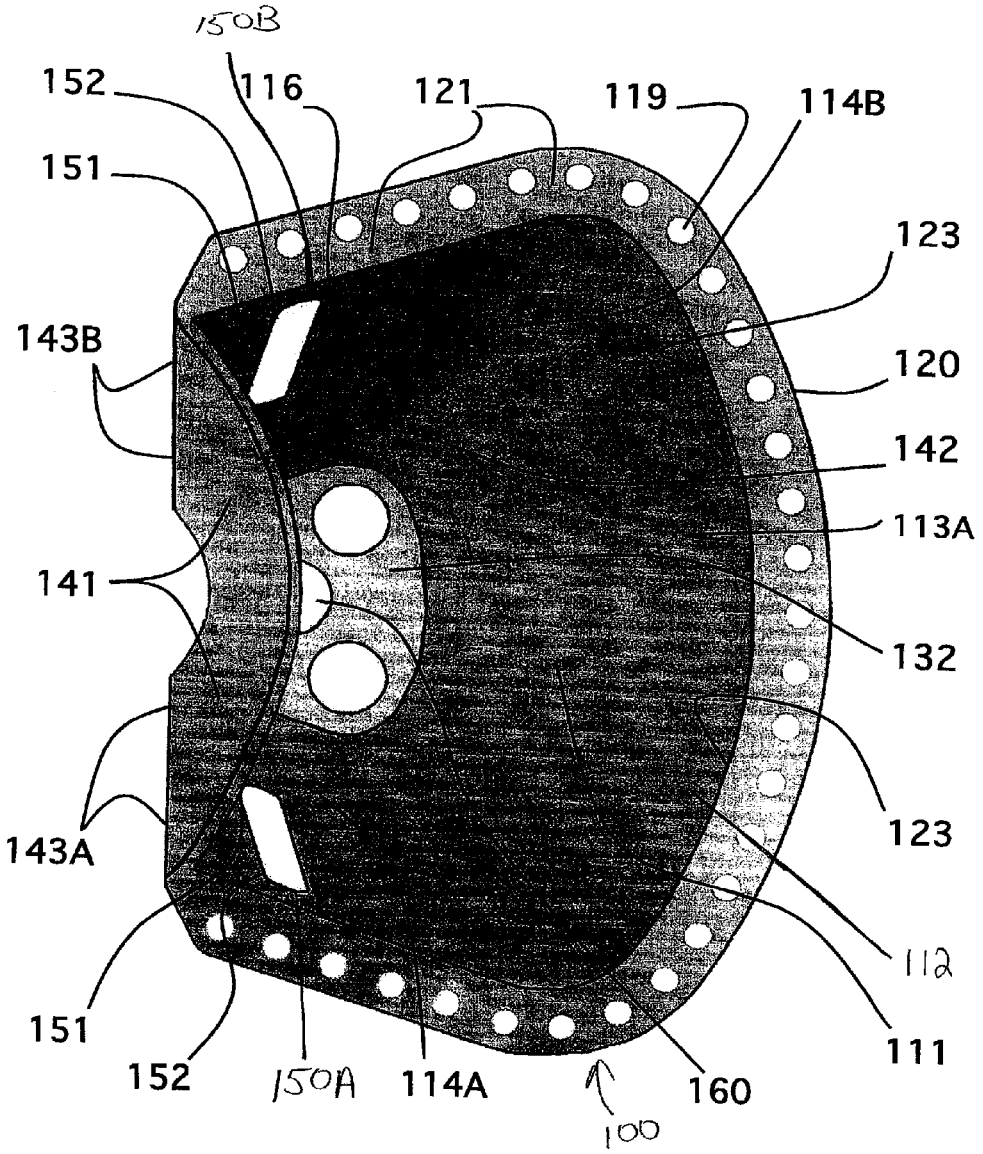
FIG. 3 is an overhead view of the climbing device of FIG. 1 in accordance with the concepts of the present invention.
Figure 4:
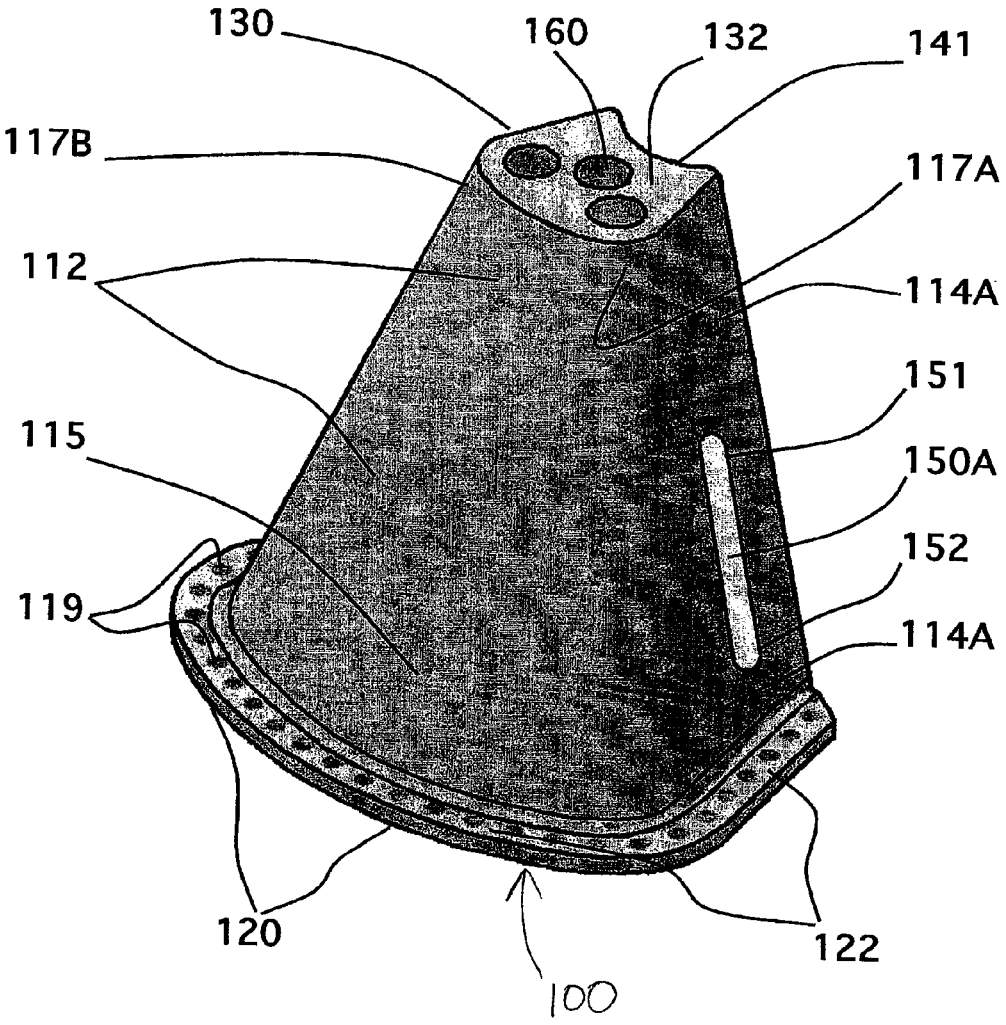
FIG. 4 is an isometric view of the climbing device of FIG. 1, shown upside down and from the front corner perspective in accordance with the concepts of the present invention.

A climbing device for attachment to a column member 140 is generally referred to by numeral 100, as shown in FIGS. 1-12 of the drawings. It should be appreciated that the column member 140 may comprise any at least partially vertically extending and substantially cylindrical member, such as a tree, pole, or post for example. Specifically, the climbing device 100 comprises a body 110 that includes an outer body section 112 that is terminated by a top step, or edge 121 and a lower rim or edge 130 and by first and second contact surfaces 143A and 143B. It should be appreciated that the contact surfaces 143A,143B may be smooth or texturized to enhance their gripping capabilities. Furthermore, the outer body section 112 has opposed inner and outer surfaces 113A and 113B. Extending between the contact surfaces 143A,143B of the outer body section 112 is a concave inner body section 141 having a concave surface 145 that is distal to or that faces away from the inner surface 113 of the outer section 112 and an opposed convex surface 142 that is proximate to or that faces the inner surface 113 of the outer body section 112. The concave inner body section 141 is terminated by opposed upper and lower ends 129 and 131 and are in respective alignment with the top step 121 and lower rim 130. In addition, the concave inner body section 141 is configured such that the width of the upper end 129 is wider than the width of the lower end 131 while the concave surface 141 maintains the same radius of curvature throughout its length. That is, the concave inner body section 111 is tapered, such that its width decreases from its upper end 129 to its lower end 131. Together, the inner and outer body sections 141 and 112 define a hollow cavity 116 within the body 110. However, it should be appreciated that the body 110 may be formed so as to be solid. It should be appreciated that the body 110 may be formed from any suitable material, including but not limited to plastic or metal for example.

The outer body section 112 includes a first curved section 115 that terminates at first and second radiused corners 117A and 117B. Extending between the first and second radiused corners 117A and 117B of the respective first and second contact surfaces 143A and 143B are respective substantially planar support sections 114A and 114B. In one aspect, while the support sections 114A,114B may be substantially trapezoidal in shape, they may be any suitable shape. The planar support sections 114A,114B are canted or angled along its longitudinal axis, such that the upper ends 129 of the support sections 114A,114B are spaced apart further than the lower ends 130 of the support sections 114A,114B are spaced apart. In addition, the support sections 114A and 114B also extend away from the center or midline of the body 110 from respective the contact surfaces 143A,143B. Thus, the planar support sections 114A and 114B are angled along two axes.

Disposed through each of the support sections 114A,114B are respective elongated retention apertures 150A and 150B, each having opposed upper/top and lower/bottom ends or regions 152 and 151. It should be appreciated that the upper/top region 152 of the retention apertures 150A-B are positioned proximate to the top edge 121 of the body 110, while the lower/bottom region 151 of the retention apertures 150A-B are positioned proximate to the lower edge 130 of the body 110. The retention apertures 150A,150B are substantially horizontally and vertically aligned with each other and are spaced from the respective contact surfaces 143A and 143B. The retention apertures 150A-B are configured to receive a flexible retention member 170 therethrough, which may include but is not limited to a strap, rope, or cable, for example. Furthermore, the retention apertures 150A,150B are dimensioned so that a sufficient distance exists between their upper and lower ends 152,151 to allow the climbing device 100 to slide or move upon the retention member 170 via the retainer apertures 150A,150B a distance when the retention member 170 is received through the retention apertures 150A,150B and through the cavity 116 of the climbing device 100 and secured to the column member 140, as discussed in detail below.

The top step 121 of the outer body section 112 may comprise any suitable edge or section. Furthermore, the top step 121 may comprise a support flange 120 that is configured to enhance the traction or grip that the user's foot or shoe achieves when placed thereon. Disposed through the support flange 120 is a plurality of apertures 119 to facilitate the enhanced traction or grip that the user's foot or shoe achieves when placed thereon. However, any other suitable traction-improving shapes, such as grooves, slots, or serrations for example, may be used.

Figure 5:
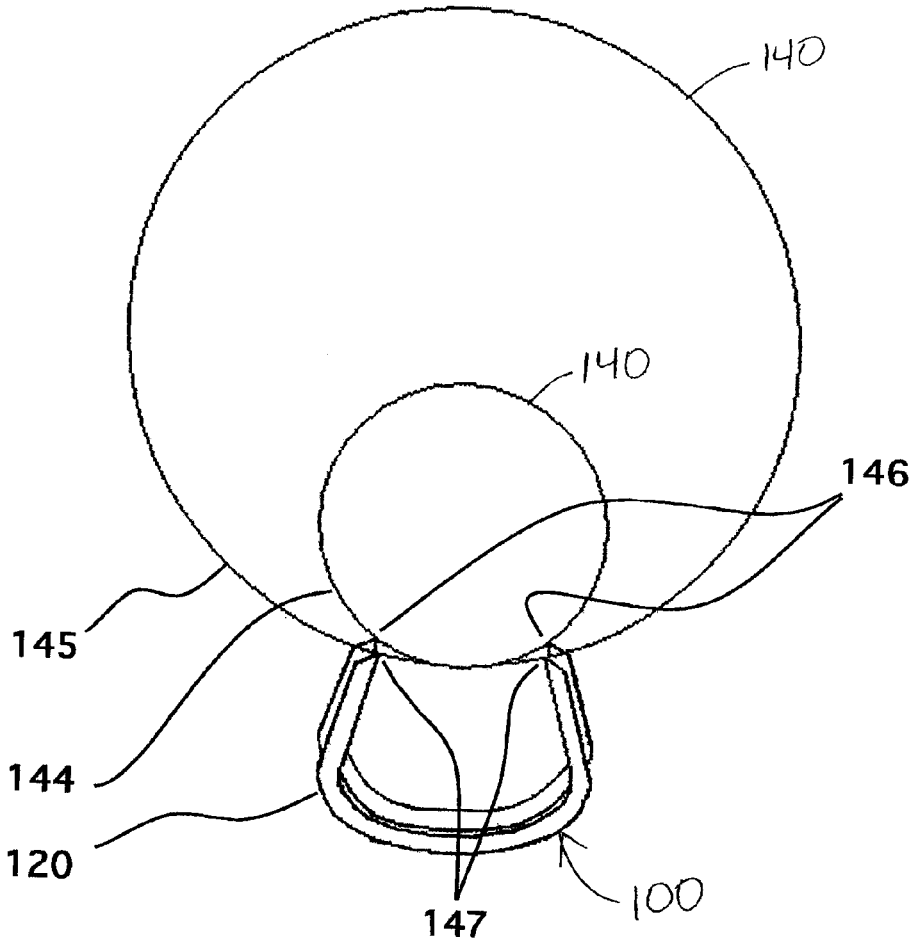
FIG. 5 is an overhead view of the climbing device of FIGS. 1 and 3, as applied to two different diameter columns in accordance with the concepts of the present invention.

When applying the climbing device 100 to the column member 140 of smaller 144 or larger 145 diameters as shown in FIG. 5, the tangent points of the smaller 146 or the larger 147 diameter column members 140 are different and thereby alter the angle of the support flange 120, moving the outer rim of the support flange 120 upward as the column member 140 diameters decrease. To compensate for the difference in the respective diameters 144 and 145 that a column member 140 may have, the climbing device 100, support flange 120, and top step 121 are angled downward as the support flange 120 projects away from the column member 140. This provides the user a concave inner tread edge 123 to a relatively perpendicular surface, depending on the column member 140 diameter, thereby enhancing traction and safety.

Attached to the lower ends 130,131 of the body 110 of the climbing device 100 is a base section 132 that includes a plurality of apertures 160 disposed therethrough so as to allow liquid, such as water, and other debris to pass through the climbing device without accumulating in the cavity 116.

Thus, when the climbing device 100 is attached to the column member 140, such as a tree for example, the contact surfaces 143A,143B are placed in contact against the outer surface of the column member 140, such that the support flange 120 is proximate to the top of the column member 140. Placing the climbing device 100 in such an orientation results in the widest portion of the concave inner body section 141 being positioned above the narrowest portion of the concave inner body section 141 when the climbing device 100 is placed in contact with the column member surface 140 prior to being secured thereto.

Figure 8:
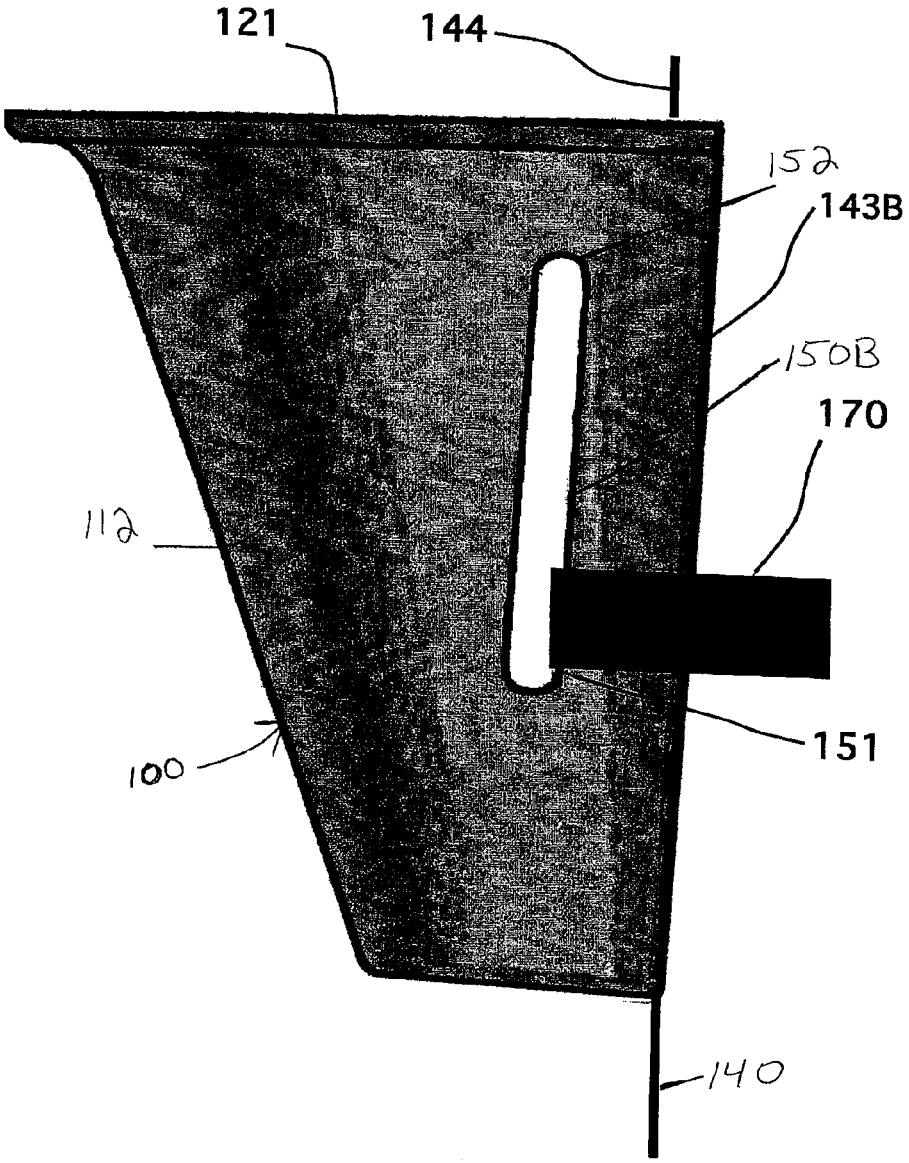
FIG. 8 is a side view of the climbing device of FIGS. 1 and 2, with the tensioning strap in the lower, or attached, position as applied to a smaller diameter column in accordance with the concepts of the present invention.
Figure 9:
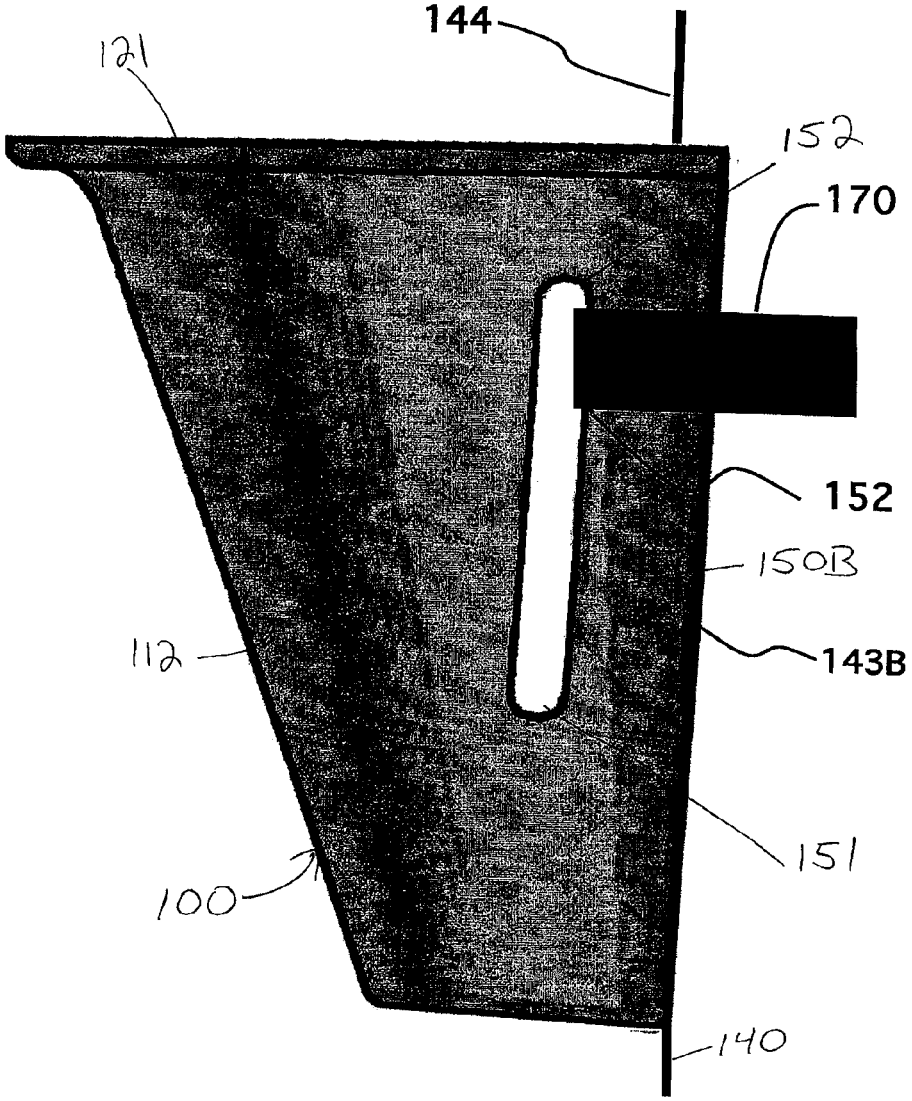
FIG. 9 is a side view of the climbing device of FIGS. 1 and 2, with the tensioning strap in the higher, or secured, position as applied to a smaller diameter column in accordance with the concepts of the present invention.
Figure 10:
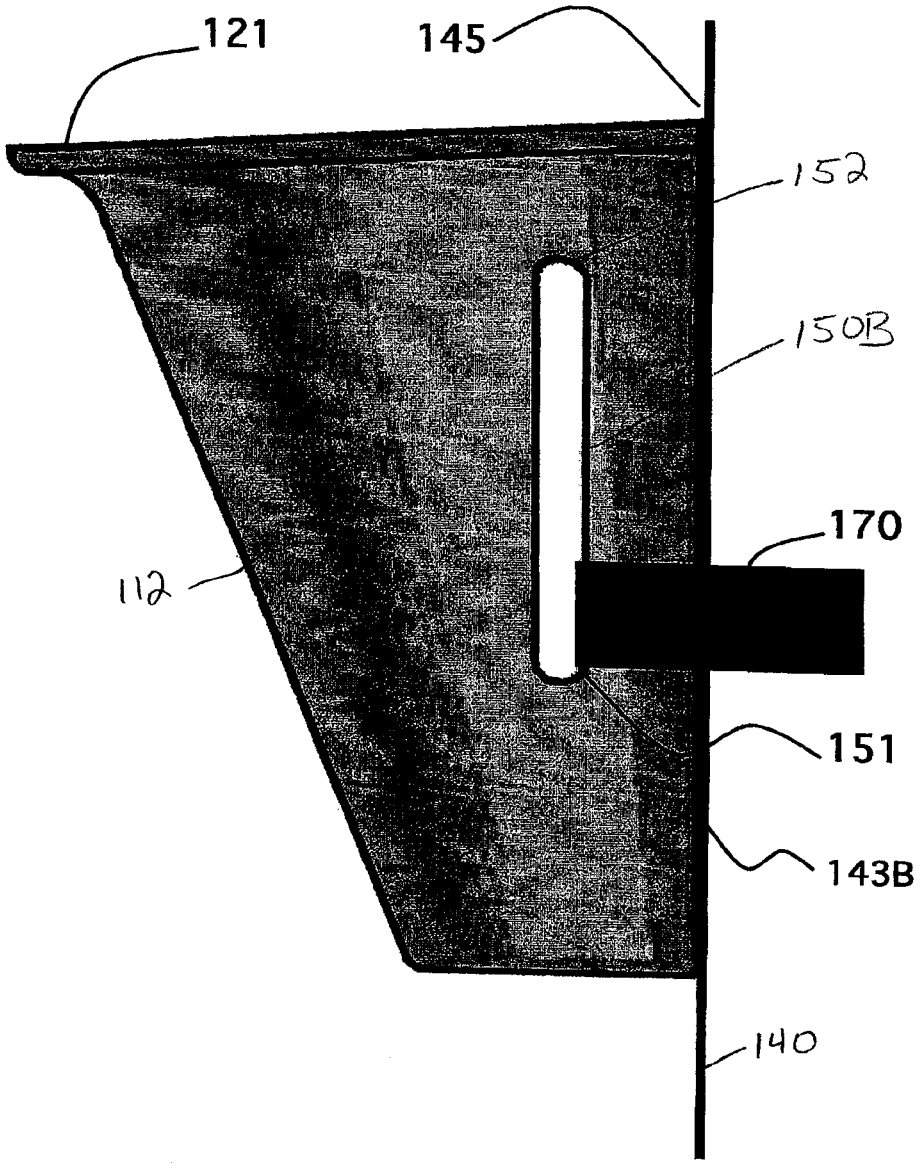
FIG. 10 is a side view of the climbing device of FIGS. 1 and 2, with the tensioning strap in the lower, or attached, position as applied to a larger diameter column in accordance with the concepts of the present invention.
Figure 13:
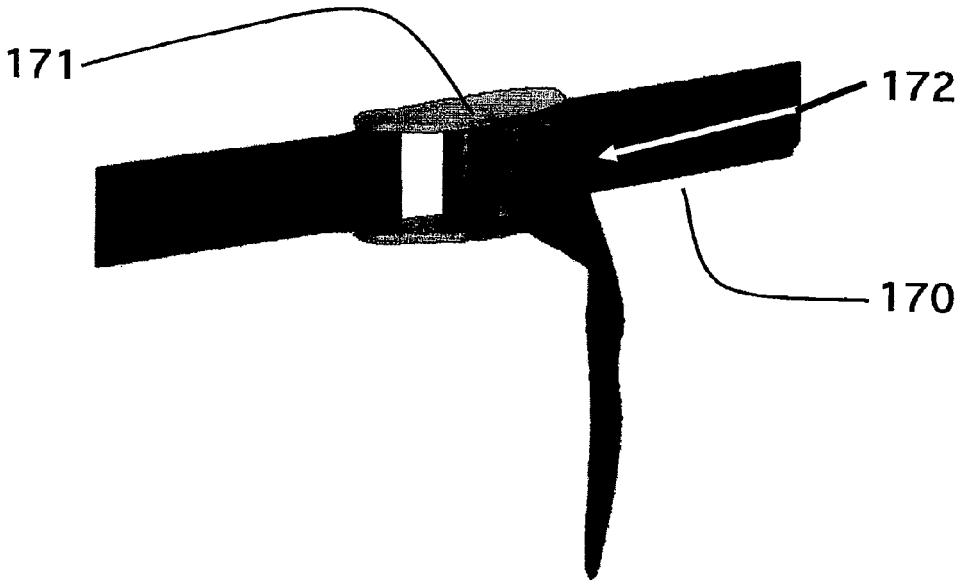
FIG. 13 is a perspective view of a cam buckle device used as a flexible retention member to removably retain the climbing device to a column member in accordance with the concepts of the present invention.

With the discussion of the structural components of the climbing device 100 set forth, the following discussion presents the manner for using the climbing device 100 with a column member 140 that comprises a tree, as shown in FIGS. 8-11. Specifically, FIGS. 8-9 relate to the use of the climbing device 100 on smaller 144 diameter column members 140, and FIGS. 10-11 relate to the use of the climbing device 100 on larger 145 diameter column members 140. To place the climbing device into use, the climbing device 100 is secured to the column member 140 by the flexible retention member 170 that is received through each of the retention apertures 150 and placed about the periphery of the column member outer surface 140. The ends of the flexible retention member 170 may be fastened together to secure the climbing device 100 to the column member 140 by tying a knot, or by using any other suitable means of fastening, such as a cam buckle device 171, and the like. Specifically, a cam buckle device 171, as shown in FIG. 13, comprises a tensioning devise that uses a flexible retention member 170 and a clamping mechanism 171 that are engaged by placing the retention member 170 through the clamping mechanism 171. Furthermore, the retention member 170 is prevented from moving in a direction that is opposite to the direction of the retention member's installation direction 172. Specifically, the retention member 170 is initially positioned within the elongated retention apertures 150 such that the lower end 151 of each of the retention apertures 150 is proximate or adjacent to the retention member 170 when the climbing device 100 is attached to the column member 140, as shown in FIGS. 8 and 10. This initial position results in the contact surfaces 143A,143B that are spaced apart by the narrower portion of the concave inner body section 141 being urged against the outer surface of the column member 140 by the retention member 170.

Figure 6:
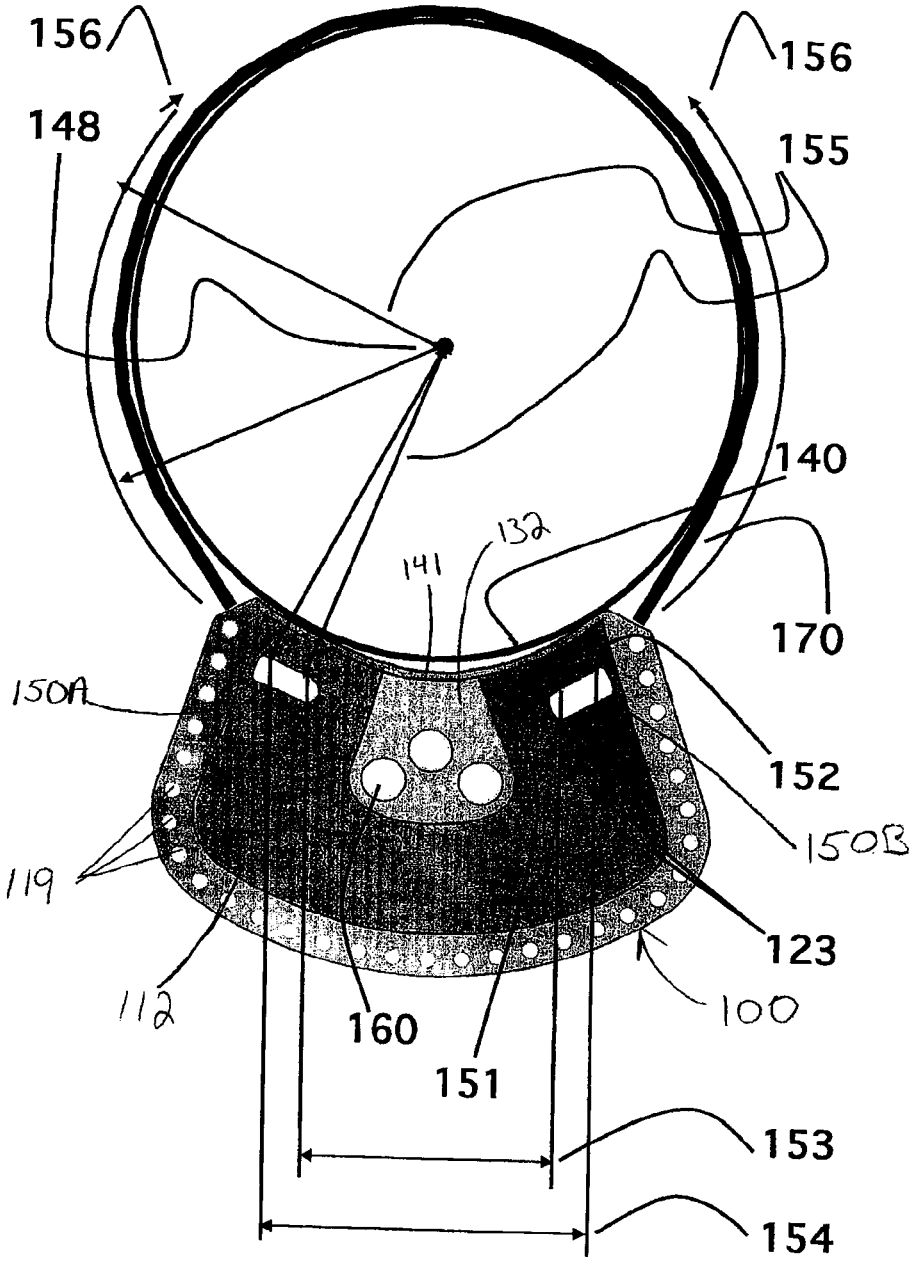
FIG. 6 is an overhead view of the climbing device of FIGS. 1 and 3, with the tensioning strap partially removed to show attributes of the climbing device's function in accordance with the concepts of the present invention.
Figure 7:
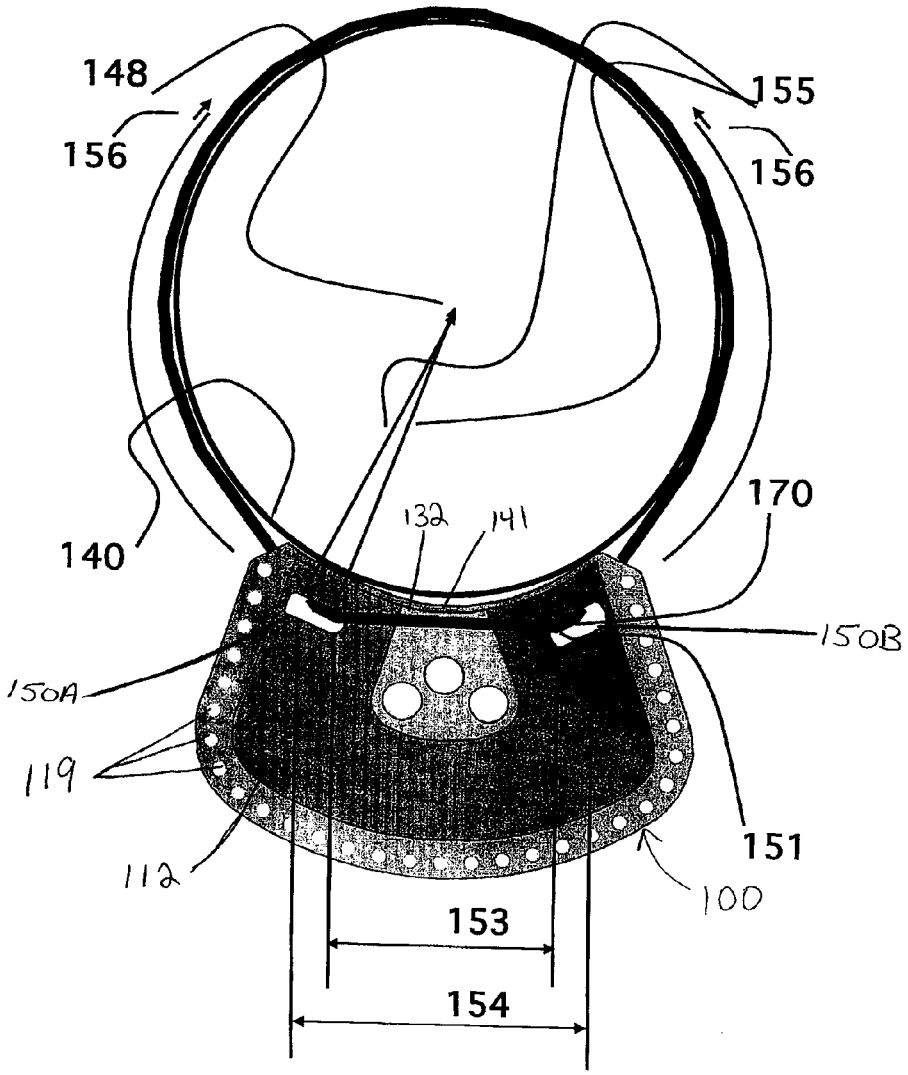
FIG. 7 is an overhead view of the climbing device of FIGS. 1 and 3, with the tensioning strap installed in the attached position in accordance with the concepts of the present invention.
Figure 11:
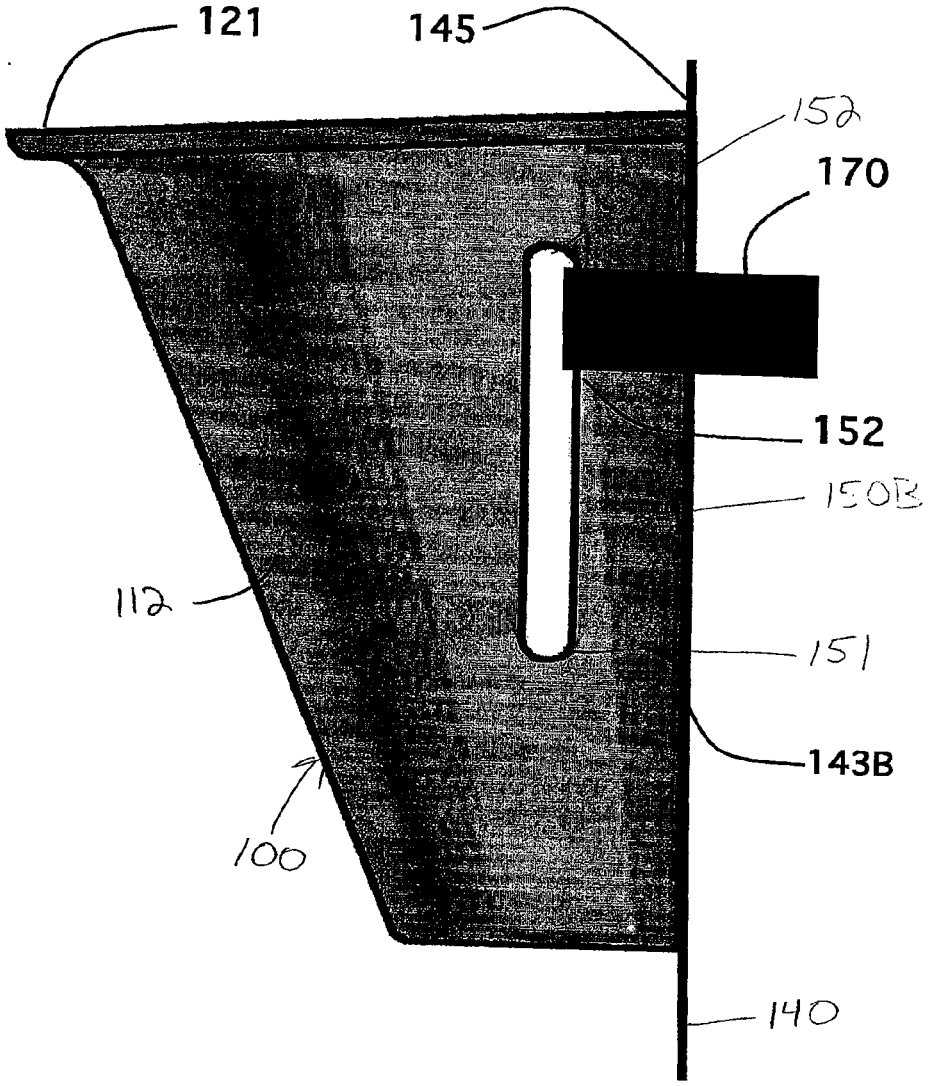
FIG. 11 is a side view of the climbing device of FIGS. 1 and 2, with the tensioning strap in the higher, or secured, position as applied to a larger diameter column in accordance with the concepts of the present invention.

Next, with the retention member 170 remaining secured to the column member 140, the climbing device 100 is moved downward, as shown in FIGS. 9 and 11, along the column member 140 such that the body 110 is moved so that the top 152 of each of the retention apertures 150A,150B is proximate or adjacent to the retention member 170. This results in the contact surfaces 143A,143B that are spaced apart by the wider portion of the concave inner body section 141 being urged against the outer surface of the column member 140 by the tension applied by the retention member 170. Furthermore, because the bottom 151 of each of the retention apertures 150A-B are closer together than the top 152 of the retention apertures 150A-B, any remaining slack in the retention member 170 that was present during the initial positioning or attachment of the retention member being proximate or adjacent to the bottom of the retention apertures 151 is taken up, causing the retention member 170 to be drawn taut as the retention apertures 150A-B are moved downward relative to the retention member 170 by moving the climbing device 100 downward relative to the stationary retention member 170. Additionally, the retention apertures 150A,150B and contact surfaces 143A,143B are parallel to each other and thereby maintain a constant radial distance from the column centerline 148. This causes the points at which the retention member 170 contacts the retention apertures 150 to move in a circumferential direction 156 away from each other 153,154 as the climbing device 100 is moved downward along the column member 140, resulting in the retention member 170 being drawn taut circumferentially 156, as shown in FIGS. 6 and 7, maintaining radial distance 155. That is, as the climbing device 100 is moved downward by applying force thereto, a greater length of the retention member 170 passes between the retention apertures 150A-B as the tops 152 of the retention apertures 150A-B are spaced further apart than the bottoms 151 of the retention apertures 150A-B. Once the climbing device 100 is moved downward, it is then fully secured to the column member 140 and can be stepped upon by a user's foot or grasped by a user's hand to carry the weight of an individual. Moreover, the process described above is repeated with multiple climbing devices 100, as the user traverses upward along the column member 140.

Figure 12:
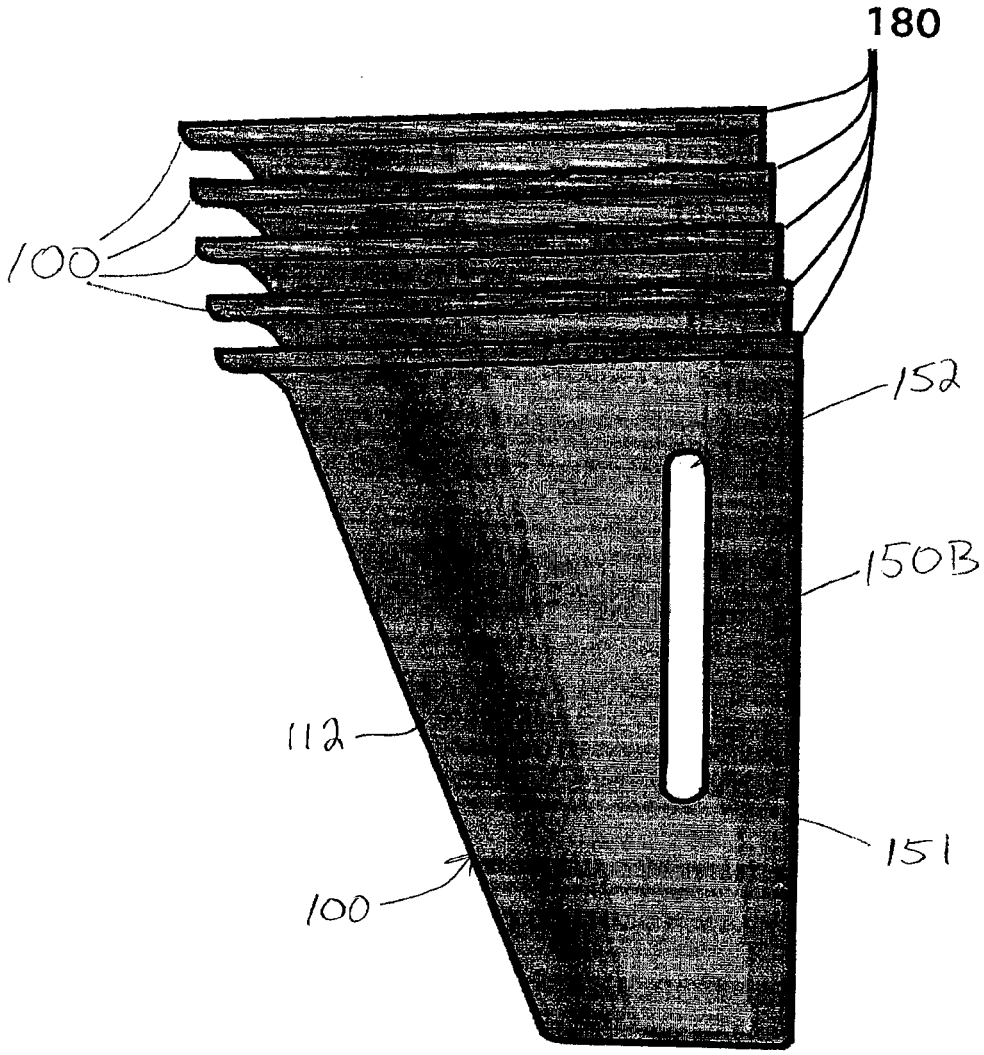
FIG. 12 is a side view of the climbing device of FIGS. 1 and 2, stacked one inside the other for transportation and storage in accordance with the concepts of the present invention.

To facilitate easy transport, the climbing device 100 may be stacked one inside the other, as shown in FIG. 12.

Figure 16:
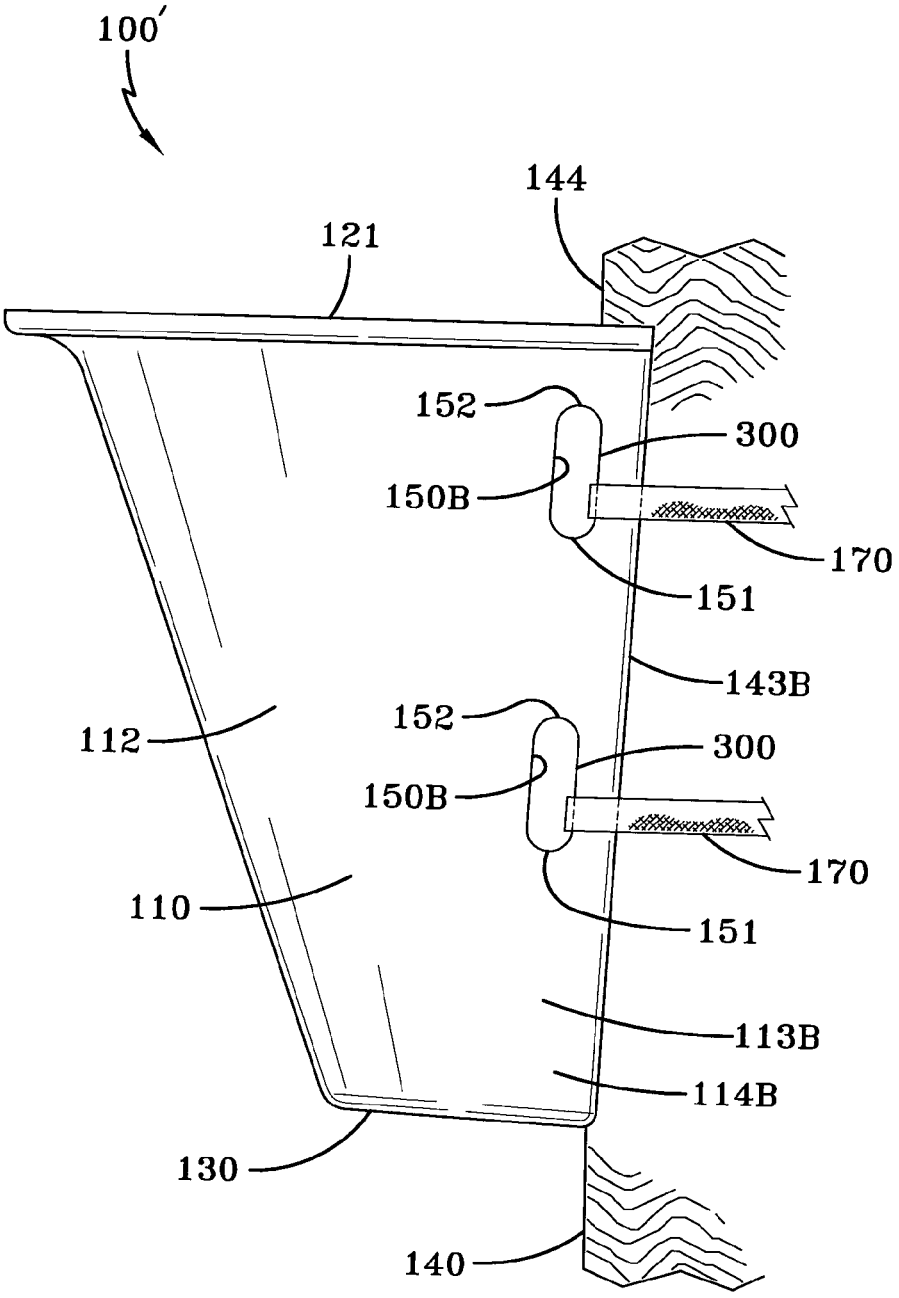
FIG. 16 is a side view of the device of FIGS. 14 and 15, with the retention members in the lower, or attached, position of the retention apertures, for attachment to a column member in accordance with the concepts of the present invention.
Figure 17:
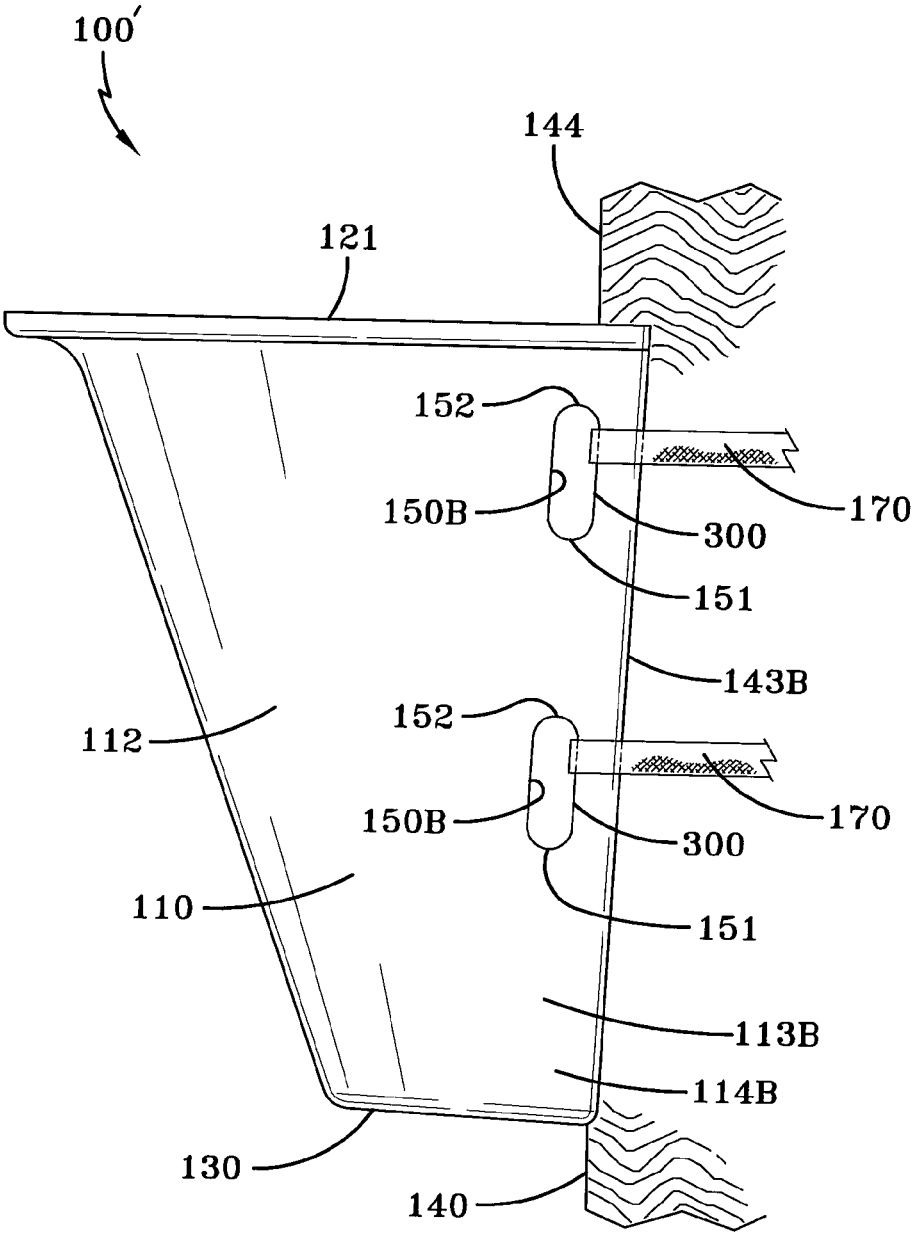
FIG. 17 is a side view of the device of FIGS. 14 and 15, with the retention members in the higher or upper, secured position of the retention apertures, for attachment to a column member in accordance with the concepts of the present invention.
Figure 18:
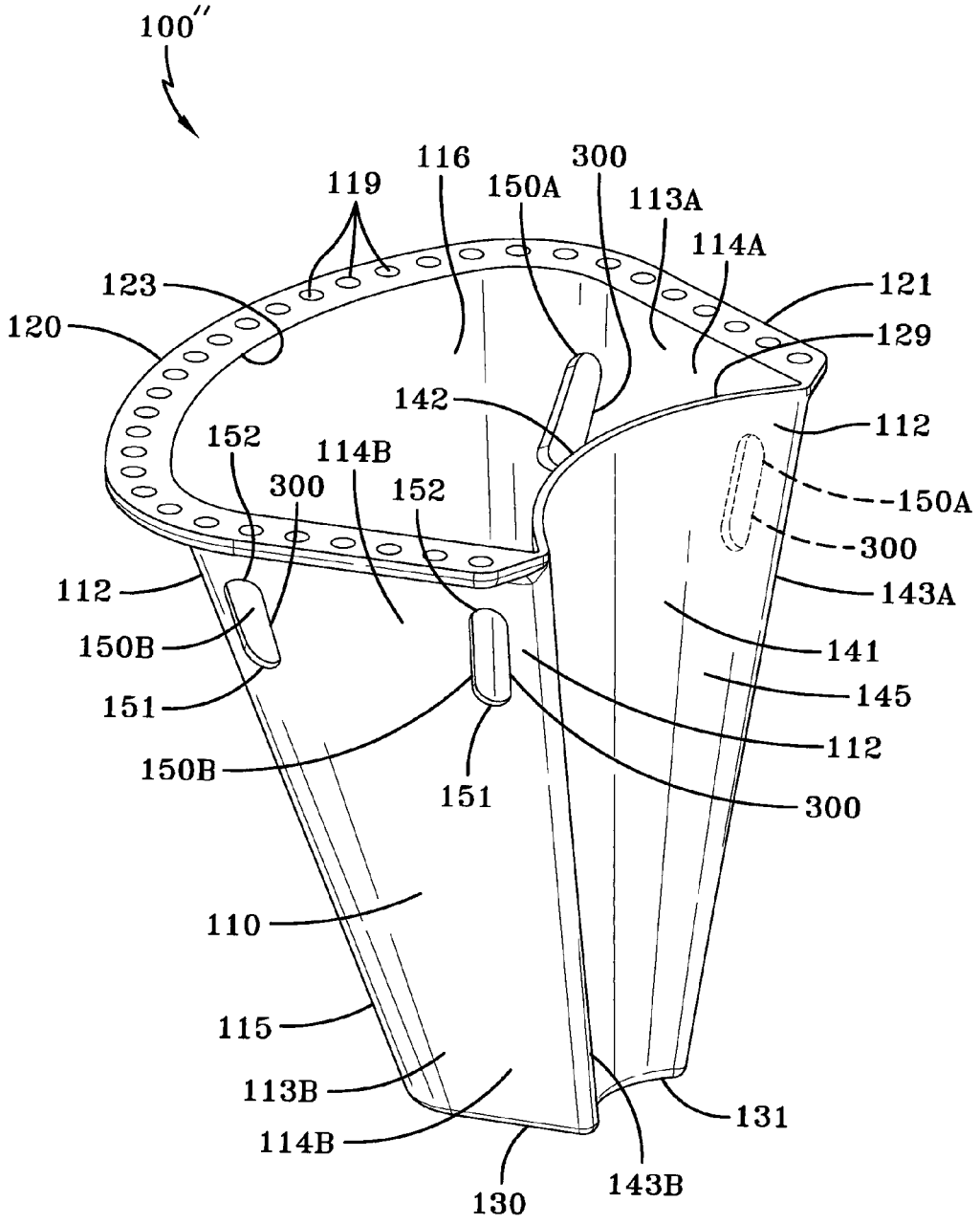
FIG. 18 is an isometric view of an alternative device using multiple horizontally aligned retention apertures in accordance with the concepts of the present invention.
Figure 19:
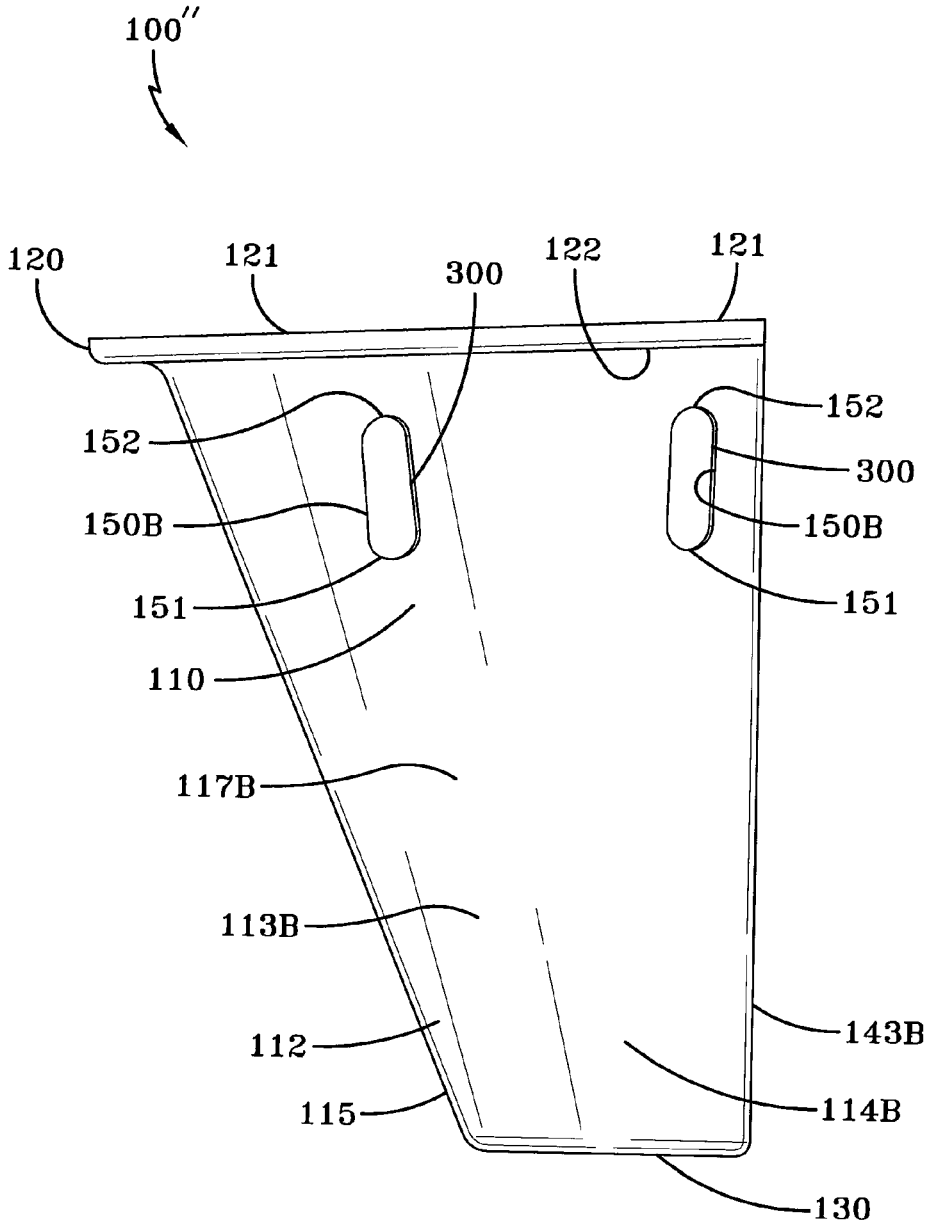
FIG. 19 is a side view of the device of FIG. 18 in accordance with the concepts of the present invention.
Figure 20:
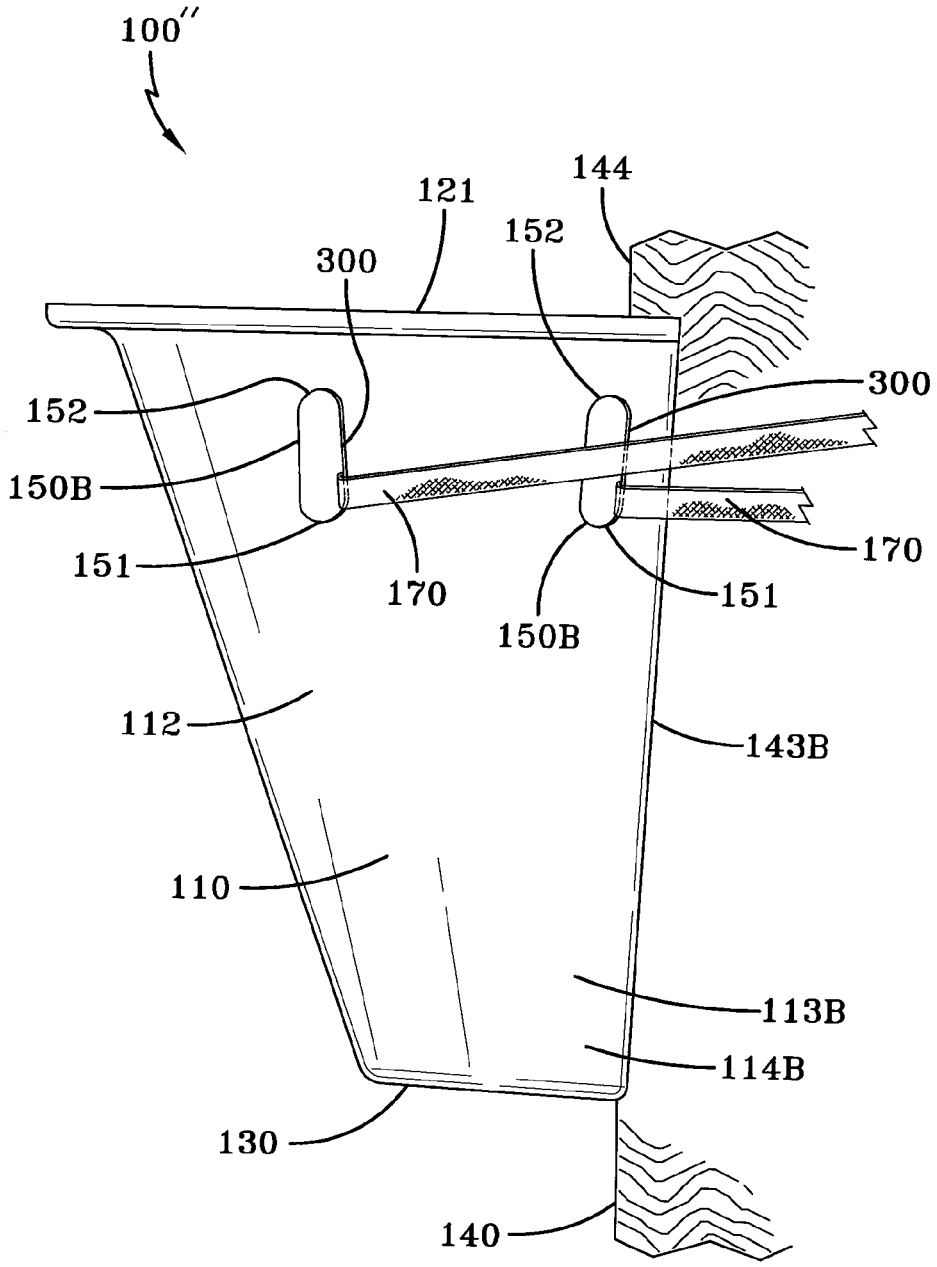
FIG. 20 is a side view of the device of FIGS. 18 and 19, with the retention members in the lower, or attached, position of the retention apertures, for attachment to a column member in accordance with the concepts of the present invention.
Figure 21:
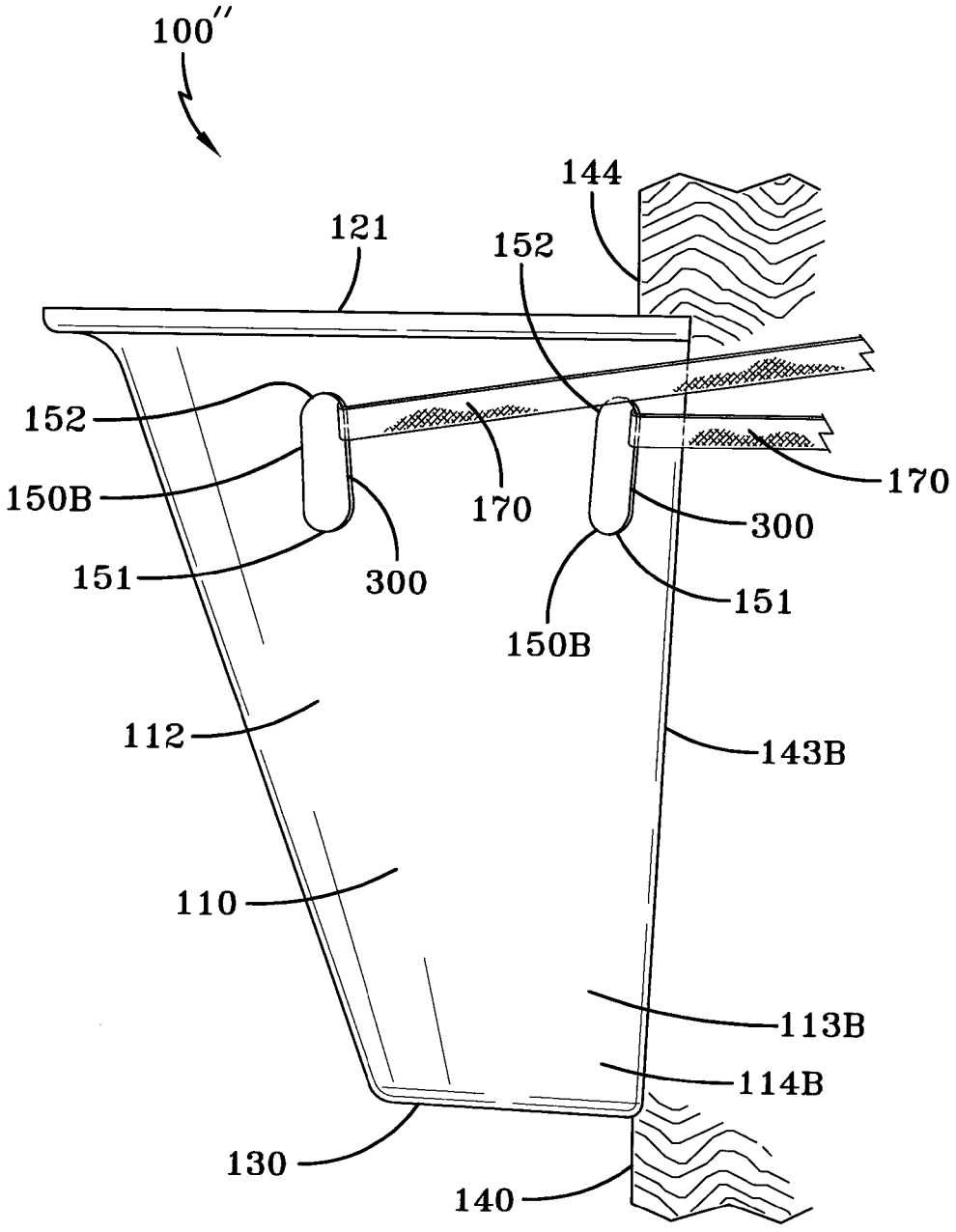
FIG. 21 is a side view of the device of FIGS. 18 and 19, with the retention members in the higher or upper, secured position of the retention apertures, for attachment to a column member in accordance with the concepts of the present invention.

In other embodiments of the device 100, designated as 100' and 100" shown in FIGS. 14-21, the support sections 114A-B of the body 110 may each include respective retention apertures 150A and 150B that are arranged, as pairs, in any suitable positional configuration. As such, the plurality of retention apertures 150A and 150B may be arranged so that one or more retention apertures 150A are arranged above (vertical alignment), and/or behind (horizontal alignment), one or more other retention apertures 150A, while one or more corresponding counterpart retention apertures 150B are arranged above (vertical alignment), and or/behind (horizontal alignment), one or more are other retention apertures 150B. That is, the support section 114A may include two or more retention apertures 150A, and the support section 114B may include two or more retention apertures 150B, provided as pairs, in various positional configurations, however for the sake of simplicity of the following discussion, only two retention apertures 150A and two retention apertures 150B (i.e. two retention aperture pairs) are discussed in the following embodiments. It should be appreciated that such additional embodiments of the device 100 operate to fasten to the column member 140 in the same manner previously discussed, with the exception that multiple pairs of retention apertures 150A,150B are moved relative to one or more retention members 170 when the body 110 of the device 100 is moved from an initial mounting position, as shown in FIGS. 16 (device 100') and 20 (device 100'), to a fastened position, as shown in FIGS. 17 (device 100') and 21 (device 100").

Figure 14:
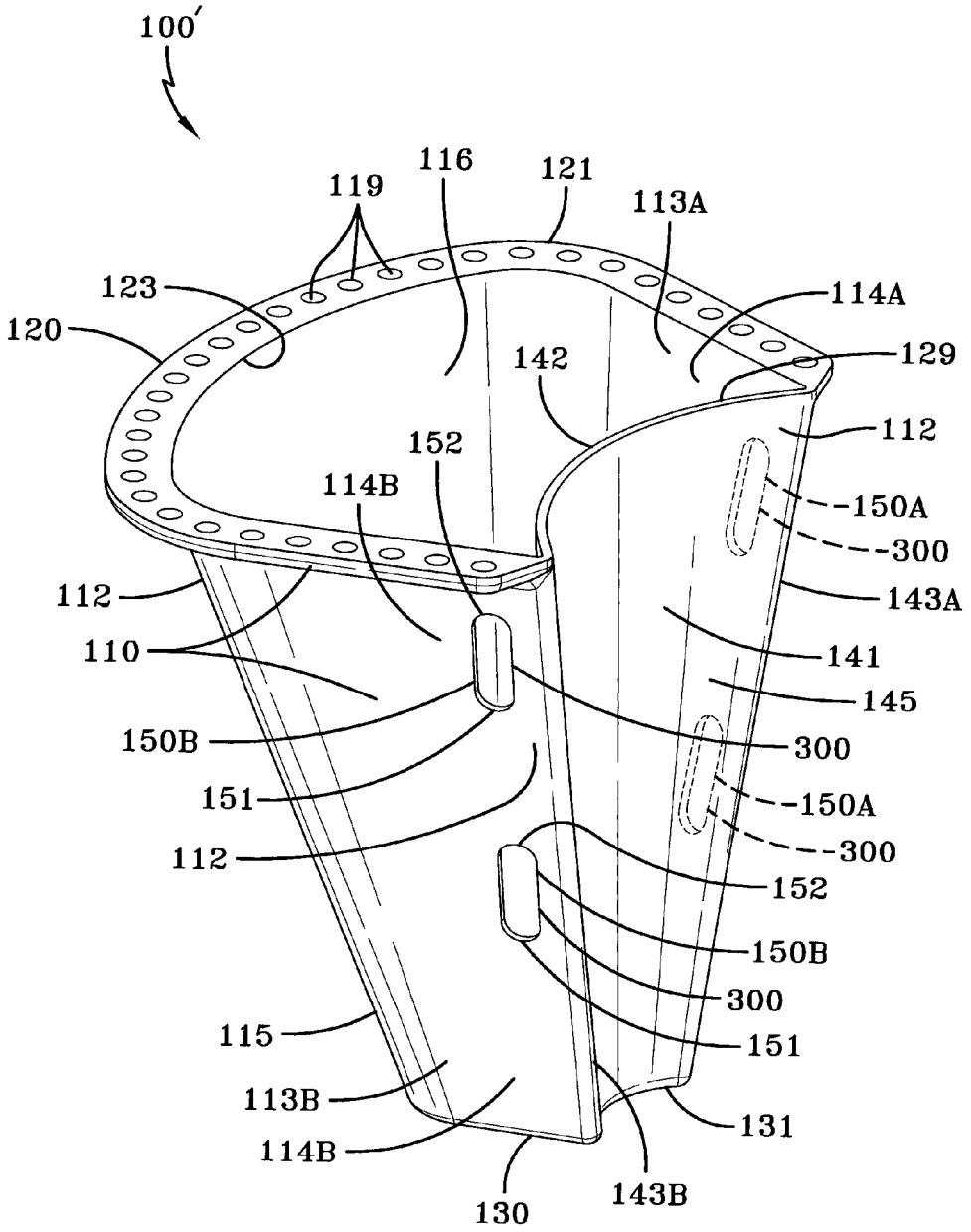
FIG. 14 is an isometric view of an alternative device using multiple vertically aligned retention apertures in accordance with the concepts of the present invention.
Figure 15:
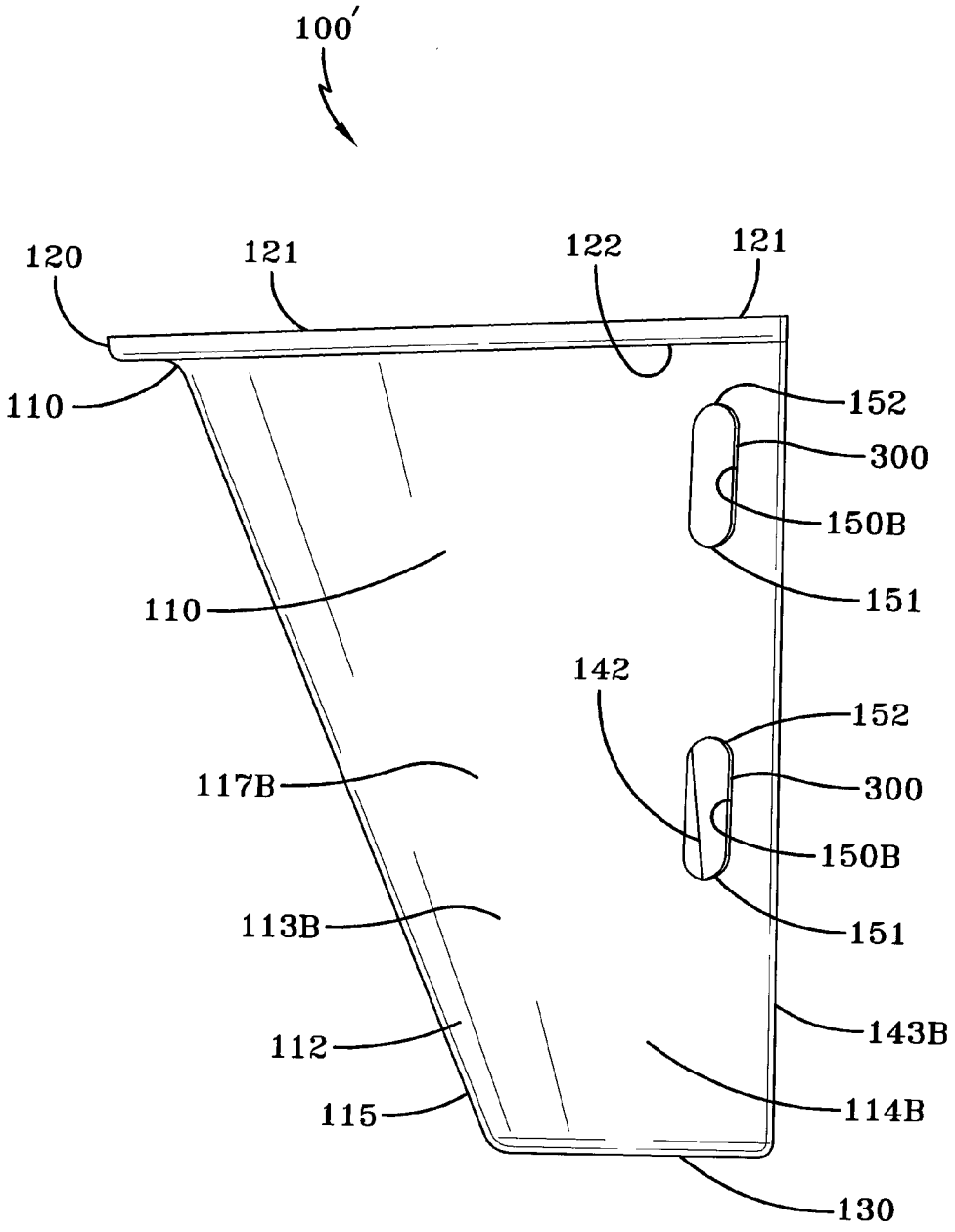
FIG. 15 is a side view of the device of FIG. 14 in accordance with the concepts of the present invention.

Specifically, with regard to device 100' shown in FIGS. 14-17, the two retention apertures 150A and the two retention apertures 150B are arranged, such that each of their upper portions 152 are proximate to the top or upper edge 121 of the body 110 and each of their lower portions 151 are proximate to the lower edge 130 of the body 110 (or such that the lower portions 151 extend at least partially towards the bottom edge 130 of the body 130). In addition, the two retention apertures 150A are aligned along a substantially vertical axis and the two retention apertures 150B are aligned with another substantially vertical axis, such that the two retention apertures 150A and the two retention apertures 150B are arranged in a stacked configuration, as shown in FIG. 14. Alternatively, each of the vertical axes associated with the two retention apertures 150A and the two retention apertures 150B may be associated with a common vertical axis or may be different axes from one another. As such, each of the two pairs of retention apertures 150A and 150B is configured to each receive the flexible retention member 170 therethrough for attachment to the column member 140, in the manner previously discussed.

With regard to device 100" shown in FIGS. 18-21, the two retention apertures 150A are arranged, such that one retention aperture 150A is positioned proximate to the contact surface 143A, and the other retention aperture 150A is positioned distal to the contact surface 143A. In one aspect, the retention apertures 150A may be substantially parallel with each other, but is not required. Similarly, the two retention apertures 150B are arranged, such that one of the retention apertures 150B is positioned proximate to the contact surface 143B, and the other retention aperture 150B is positioned distal to the contact surface 143B. In one aspect, the retention apertures 150B may be substantially parallel with each other, but is not required. In addition, the two retention apertures 150A may be aligned along a substantially horizontal axis and the two retention apertures 150B may be aligned along a substantially horizontal axis, such that each horizontal axis may be associated with a common horizontal axis, or may be different axes from one another. As such, each of the two pairs of retention apertures 150A and 150B is configured to each receive a flexible retention member 170 therethrough for attachment to the column member 140, in the manner previously discussed. In other embodiments, it should be appreciated that a single retention member 170 may be laced through each of the 2 pairs of retention apertures 150A and 150B, such that the retention member 170 enters the retention aperture 150B proximate to the contact surface 143B; exits the retention aperture 150B distal to the contact surface 143B; enters the retention aperture 150A distal to the contact surface 143A; and exits the retention aperture 150A proximate to the contact surface 143A.

As such, the use of additional retention members 170 increases the amount of tensioning force that is applied to secure the device 100' and 100" to the column member 140, which is desirable.

In yet another embodiment, the retention apertures 150A and 150B may be arranged in any desired angle relative to respective contact surfaces 143A and 143B. For example, the longitudinal axis of the retention apertures 150A and 150B may be arranged at an angle that is less than (acute) or greater than (obtuse) 90 degrees from an intersecting horizontal axis.

Figure 22:
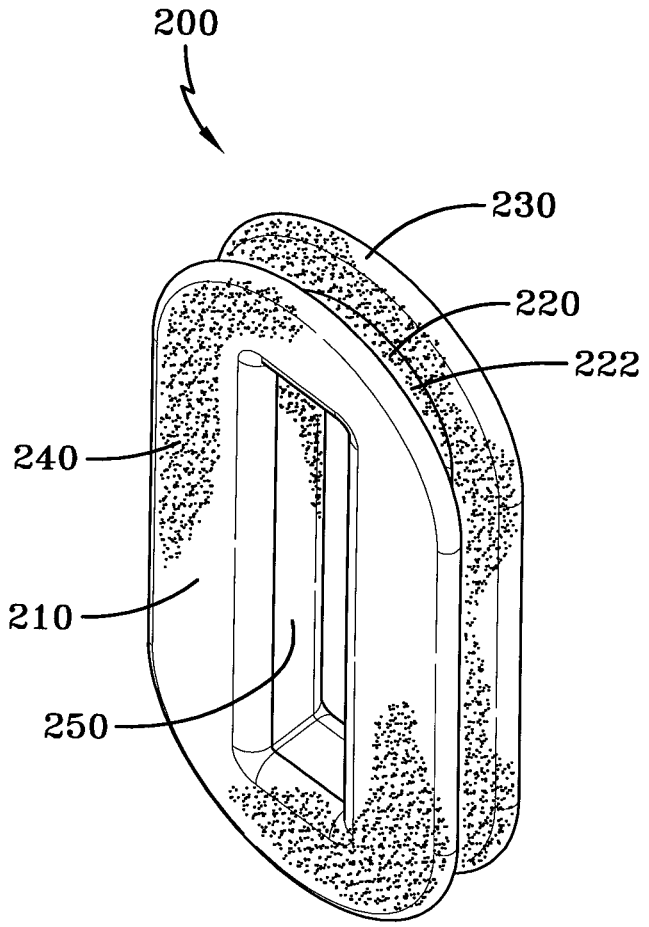
FIG. 22 is a perspective view of a grommet for slideably carrying the retention member in the retention apertures of the device in accordance with the concepts of the present invention.

In addition, to facilitate the sliding of the body 110 of the device 100,100',100" relative to the retention member(s) 170 during mounting of the device to the column member 140 in the manner previously discussed, a sliding grommet or carrier 200, as shown in FIG. 22, may be slideably disposed in each of the retention apertures 150A and 150B. The grommet 200 includes a body 210 having a substantially elongated shape, however, it should be appreciated that the body 210 of the grommet 200 may be any suitable shape, such as a curvilinear shape, a rectilinear shape, or any combination thereof, such as oval or rectangular shape for example. The body 210 includes a receiving channel 220 that circumscribes the outer periphery or edge 222 of the body 210, and that is formed between a pair of spaced, lateral walls 230 and 240 that outwardly extend from the edge 222. Disposed through a central portion of the body 210 is a receiving aperture 250, which may be configured to be any suitable shape, such as a rectilinear shape, a curvilinear shape or combination thereof. For example, in some embodiments, the receiving aperture 250 may comprise a rectangular shape, as shown in FIG. 22, which is dimensioned to receive the retention member 170 therethrough, while preventing the retention member 170 from wrinkling or buckling upon itself as the device 100, 100', 100" as the device 10 is being slid downward as it is secured to the column member 140 in the manner previously discussed.

To slideably retain the grommet 200 within each of the retention apertures 150A,150B, the substantially parallel edges 300 of each of the retention apertures 150A,150B are received within the receiving channel 220 of the grommet 200, as the lateral walls 230 and 240 of the grommet 200 serve to retain or capture the edges 300 of the retention apertures 150A,150B therein. It should be appreciated that the grommet 200 may be formed out of any suitable material, such as plastic, TEFLON, metal, or combination thereof.

Figure 23:
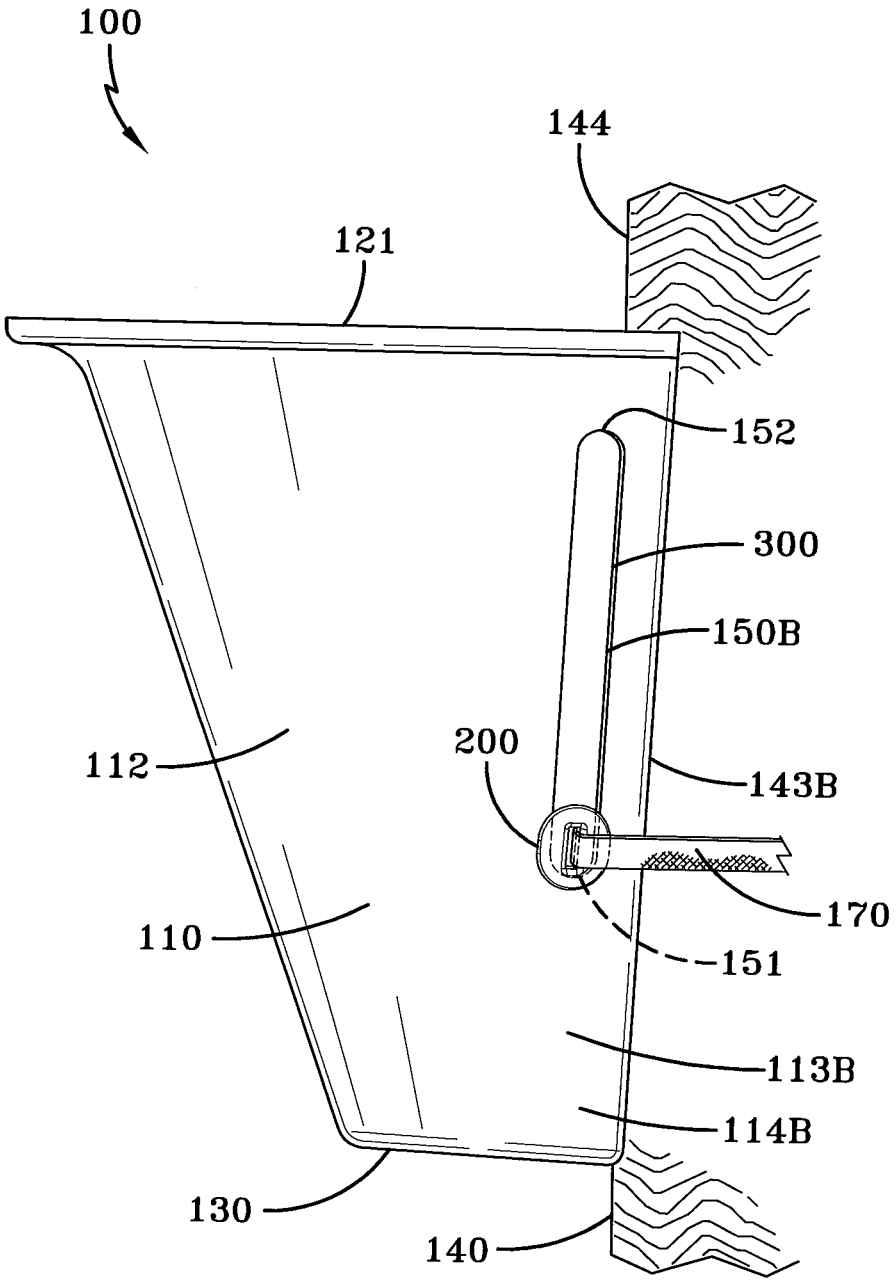
FIG. 23 is a side view of the device of the present invention including the grommets of FIG. 22 when the retention member is positioned in the lower portion of the retention apertures when the device is initially attached to the column member in accordance with the concepts of the present invention.
Figure 24:
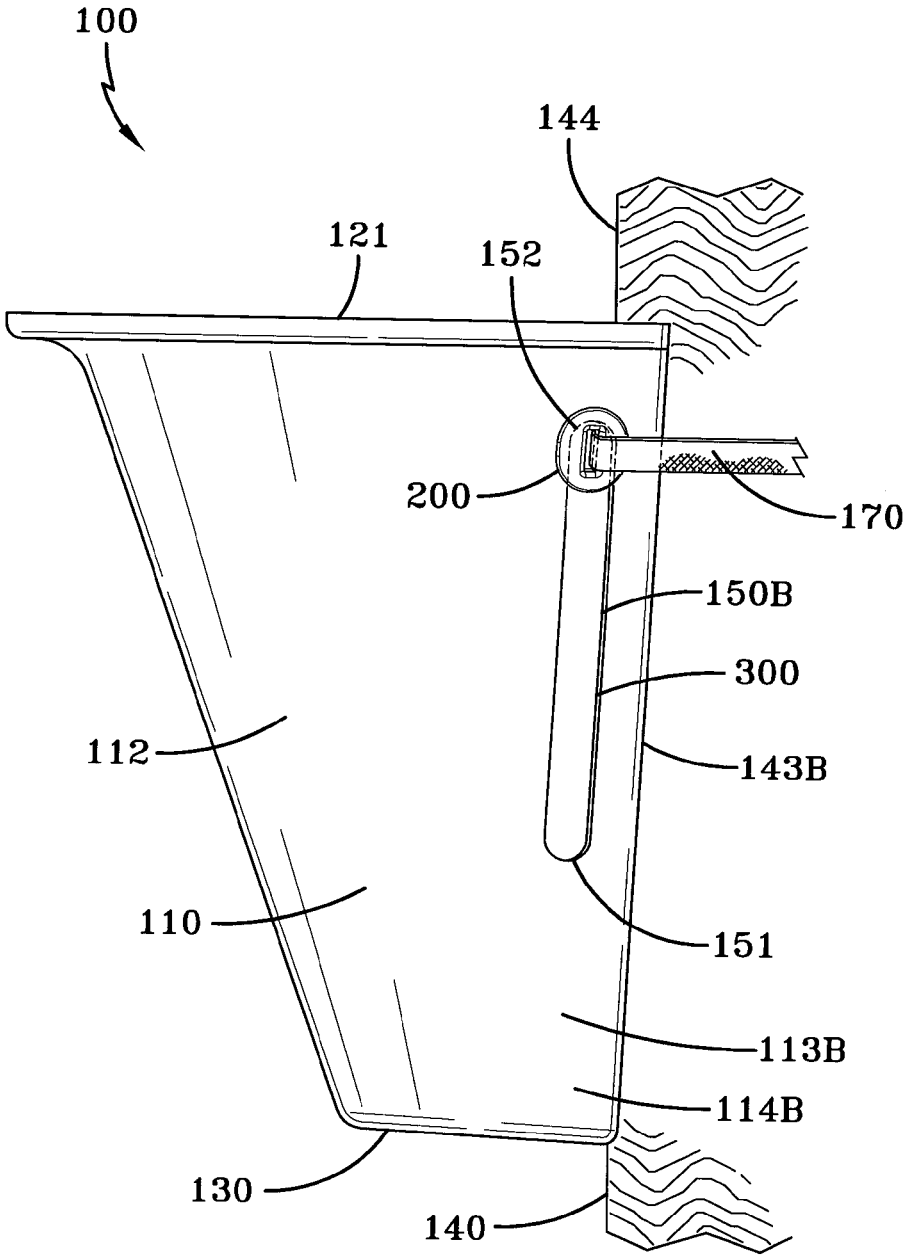
FIG. 24 is a side view of the device of the present invention including the grommets of FIG. 22 when the retention member is positioned in the upper portion of the retention apertures to finally attach the device to the column member in accordance with the concepts of the present invention.

As such, when the device 100 is attached to the column member 140 in the manner previously discussed, as shown in FIGS. 23 and 24, such that the body 110 is moved downward from an initial position (FIG. 23) relative to the fixed retention member 170 to a fastened position (FIG. 24), the grommets 200 facilitate the sliding movement of the device 100 relative to the fixed retention member 170.

Figure 25:
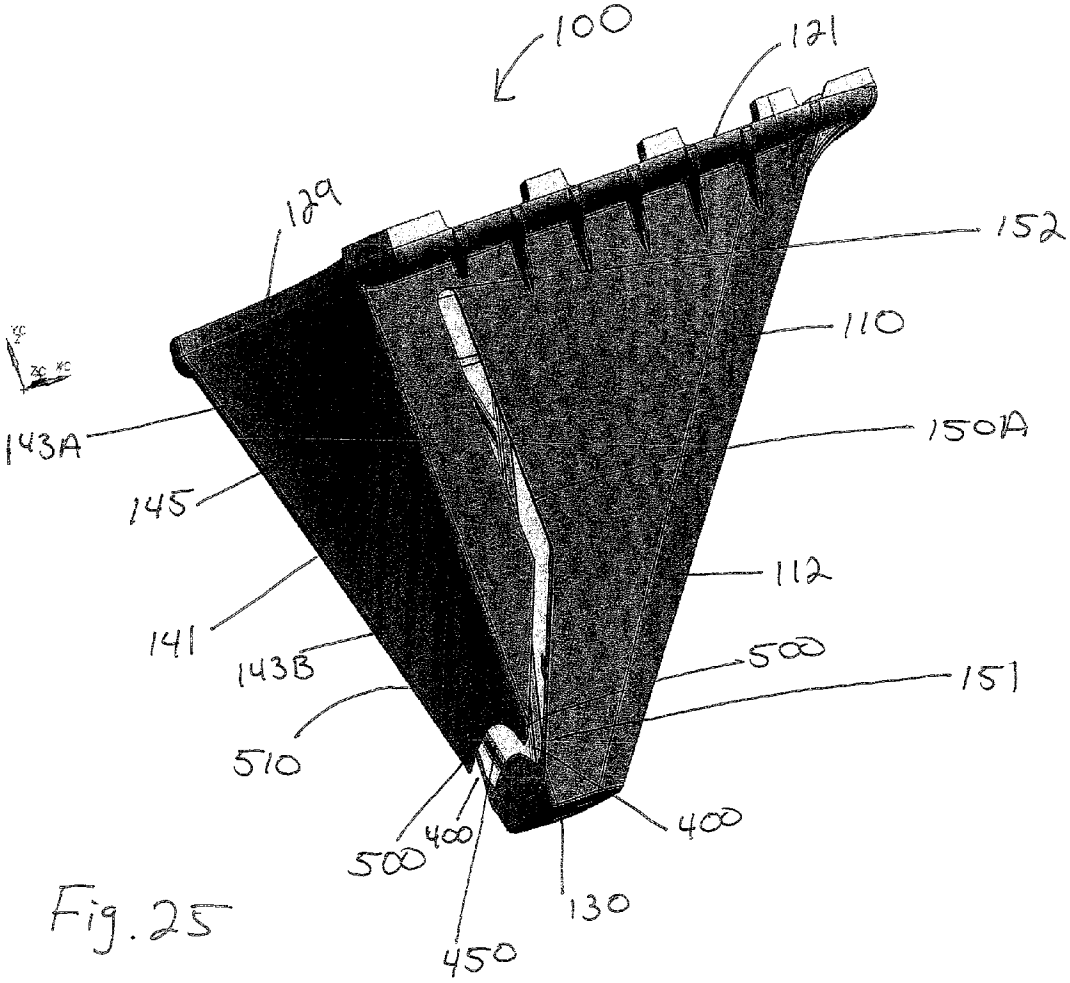
FIG. 25 is a perspective view of a further alternative device in accordance with the concepts of the present invention.
Figure 26:
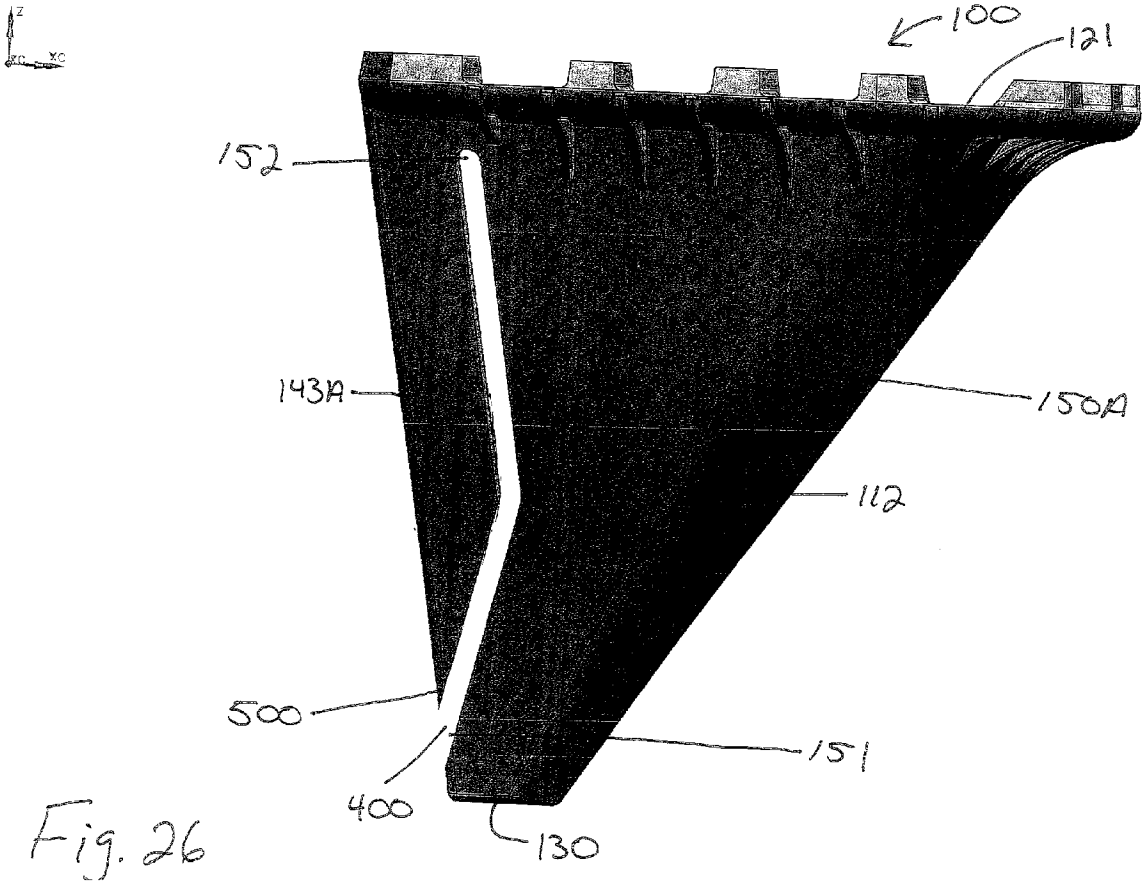
FIG. 26 is an elevational view of the alternative device shown in FIG. 25 in accordance with the concepts of the present invention.
Figure 27:
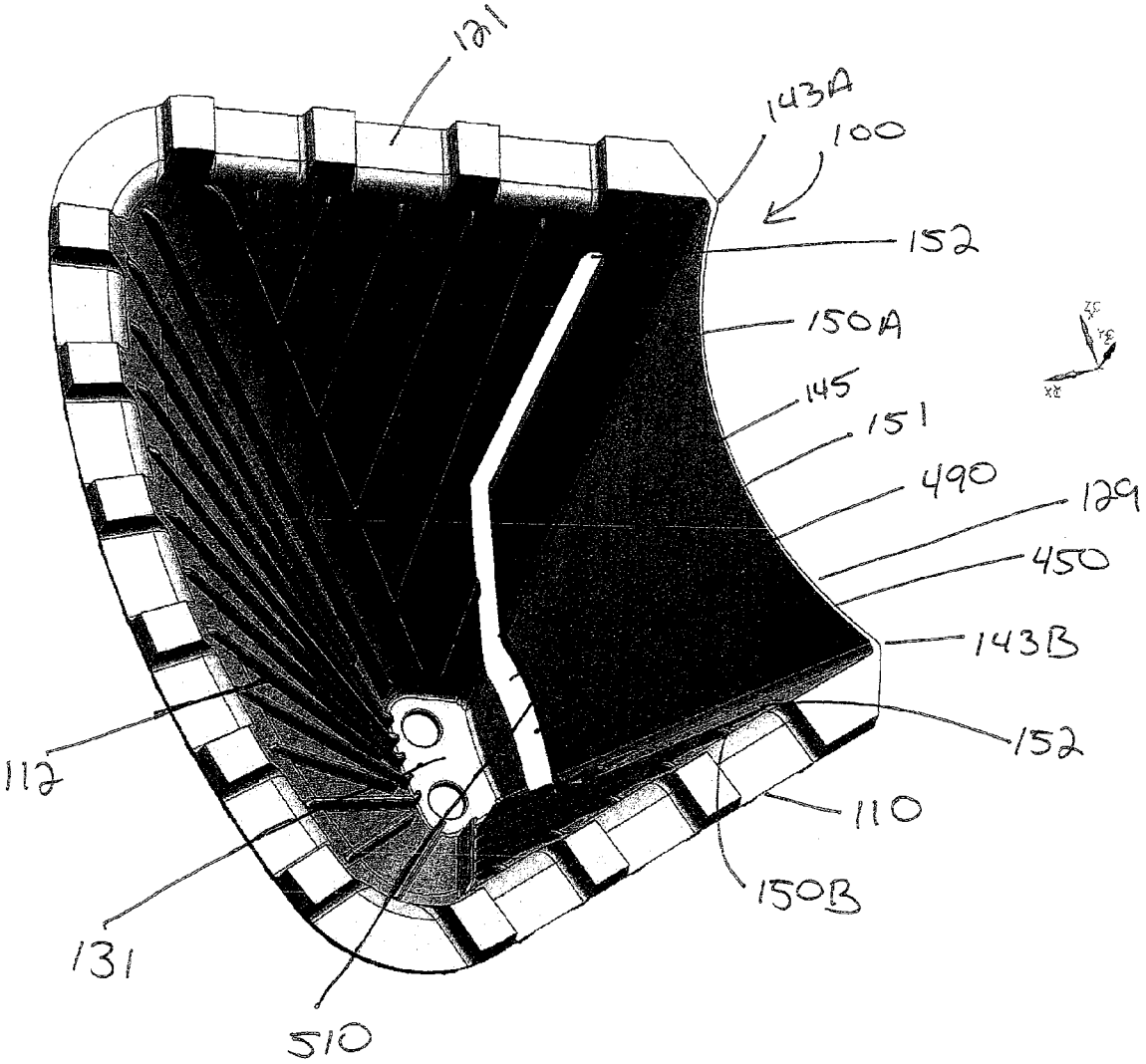
FIG. 27 is a top perspective view of the alternative device shown in FIG. 25 in accordance with the concepts of the present invention.

In yet another embodiment, the device 100 may be configured as shown in FIGS. 25-27, in particular, the elongated retention apertures 150A and 150B may be configured, such that their lower ends or regions 151 terminate at openings 400. In one aspect, the openings 400 of the respective retention apertures 150A-B are disposed in the respective contact surfaces 143A-B. In other embodiments, the openings 400 of the retention apertures 150A-B may be positioned adjacent or proximate to the contact surfaces 143A-B. In some embodiments, the retention apertures 150A-B may extend to their respective openings 400 along a radiused or curved path; or may be configured to extend to the openings 400 along a path that is rectilinear, curvilinear or a combination of both.

Still, in other embodiments, the openings 400 provided by both the retention apertures 150A-B may be connected together by an optional elongated lateral aperture 450 that extends through the concave inner body section 141 between the ends/regions 151 of the retention apertures 150A-B. As such, when the elongated lateral aperture 450 is used to connect the openings 400 of both of the elongated retention apertures 150A-B together, a single continuous elongated aperture 490 is formed. Due to the concave surface 145 of the concave inner body section 141 and the angle in which the elongated lateral aperture 450 is disposed therein, a pair of spaced protrusions 500 are formed by the ends each of the contact surfaces 143A-B adjacent to the aperture 450. Specifically, the protrusions 500 are formed by a concave edge 510 of the concave inner body section 141. In some embodiments, the elongated lateral aperture 450 is positioned proximate to the lower edge 130 of the body 110 of the device 100.

As such, it is submitted that the tensioning operation of the device 100 using the openings/apertures 400, as well as using the openings 400 together with an elongated lateral aperture or opening 450, is the same as that previously discussed with the other embodiments of the device 100 discussed herein. However, the openings and aperture 400, 450 enable the retention member 170 to be first attached to the column member 140, so that as a second step the device 100 is attached to the retention member 170 so that the openings and aperture 400,450 receive the retention member 170 therein to initially attach the device 100 to the fixed retention member and the column member 140. Once the device 100 is initially attached to the column member 170 and to the retention member 170, the device 100 is then further fastened by forcing the body 110 of the device 100 downward in the manner previously discussed herein.

Therefore, one advantage of the present invention is that a climbing device for climbing a column member is strong, lightweight, and quiet when in use and in transport. Some other advantages of the present invention due to its shape are a climbing device for climbing a column member that includes tread surface angle of a support flange to compensate for different diameter columns. Still another advantage of the present invention is that a climbing device for climbing a column member includes spaced and tapered contact surfaces to contact the outer surface of the column member. Yet another advantage of the present invention is that a sliding grommet may be disposed in the retention apertures of the device to carry a fixed retention member therethrough, so as to facilitate the movement of the device relative to the fixed retention member.

It will be understood that the embodiments described herein are merely exemplary and that a person skilled in the art may make many modifications and variations without departing from the spirit and scope of the invention. All such variations and modifications are intended to be included within the scope of the invention as defined in the appended claims.

What is claimed is:

1. A device for attachment to a column member, the device further comprising:

a body having a top edge and a bottom edge, said body having a longitudinal axis;

a first contact surface and a second contact surface, spaced apart, and extending at least partially between said top edge and said bottom edge;

a first support section extending from at least one of said top edge or said bottom edge, said first support section proximate to said first contact surface;

a second support section extending from at least one of said top edge or said bottom edge, said second support section proximate to said second contact surface; and a first elongated retention aperture disposed through said first support section and spaced from said first contact surface, and a second elongated retention aperture disposed through said second support section and spaced from said second contact surface, said first and second retention apertures each having a top portion proximate to said top edge and a bottom portion extending at least partially towards said bottom edge to an opening, wherein said first support section and said second support section diverge away from the longitudinal axis of said body from said bottom edge to said top edge, such that said top portions of said first and second retention apertures are spaced further apart from each other than said bottom portions of said first and second retention apertures are spaced apart from each other;

wherein said first and second retention apertures are configured to receive a flexible retention member therethrough to attach said body to the column member, such that said flexible retention member remains fixed in position relative to the column member, whereby said first and second retention apertures are slideable relative to the retention member, such that only said top portions of said first and second retention apertures or said bottom portions of said first and second retention apertures are positionable proximate to the retention member at any one time; wherein said opening of said first retention aperture is disposed in said first contact surface and said opening of said second retention aperture is disposed in said second contact surface.

2. The device of claim 1, further comprising:

a concave section disposed between said first contact surface and said second contact surface;

an elongated lateral aperture disposed through said concave section;

wherein said elongated lateral aperture connects said opening of said first elongated retention aperture to said opening of said second elongated retention aperture.

* * * * *